US010159293B2

(12) United States Patent
Sunness et al.

(10) Patent No.: US 10,159,293 B2
(45) Date of Patent: Dec. 25, 2018

(54) HAT WITH THICK BRIM FACE

(71) Applicant: THiiK LLC, Scarsdale, NY (US)

(72) Inventors: Brooke Danielle Sunness, Scarsdale, NY (US); Bob Robert Sunness, Scarsdale, NY (US); Alex John Monroe, Toms River, NJ (US)

(73) Assignee: THiiK LLC, Scarsdale, NY (US)

( * ) Notice: Subject to any disclaimer, the term of this patent is extended or adjusted under 35 U.S.C. 154(b) by 193 days.

(21) Appl. No.: 14/745,807

(22) Filed: Jun. 22, 2015

(65) Prior Publication Data

US 2016/0366966 A1 Dec. 22, 2016

(51) Int. Cl.

| | |
|---|---|
| ***A42B 1/00*** | (2006.01) |
| ***A42B 1/06*** | (2006.01) |
| ***A42B 1/02*** | (2006.01) |
| ***A42B 1/24*** | (2006.01) |
| ***A42C 1/08*** | (2006.01) |

(52) U.S. Cl.

CPC ..... *A42B 1/004* (2013.01); *A42B 1/02* (2013.01); *A42B 1/062* (2013.01); *A42B 1/248* (2013.01); *A42C 1/08* (2013.01)

(58) Field of Classification Search

CPC ..... A42B 1/004; A42B 1/02; A42B 1/062; A42B 1/248; A42C 1/08; A42C 5/00

USPC ..... 2/195.1; 362/106

See application file for complete search history.

(56) References Cited

U.S. PATENT DOCUMENTS 2,088,930 A 8/1937 Schwarz
2,416,062 A * 2/1947 Mercer ..... A42B 1/02 2/175.5
3,016,545 A * 1/1962 Donahue ..... A42B 1/062 2/10
3,346,876 A * 10/1967 Hutton ..... A42B 1/062 2/10
4,549,316 A 10/1985 Johnson
D302,608 S * 8/1989 LaPierre ..... D2/893
4,914,755 A 4/1990 Motley
4,982,449 A 1/1991 Finkelstein
(Continued)

FOREIGN PATENT DOCUMENTS

KR 200451806 1/2011
WO 2016209306 12/2016

OTHER PUBLICATIONS

Sunness, Brooke Danielle; Office Action for Canadian design application No. 168,935, filed Nov. 13, 2015, dated Jul. 19, 2016, 2 pgs.
(Continued)

*Primary Examiner* — Alissa Tompkins
*Assistant Examiner* — Griffin Hall
(74) *Attorney, Agent, or Firm* — Taylor English Duma LLP

(57) ABSTRACT

A hat brim includes: an upper surface; a lower surface; and a face, the face extending from an outer edge of the upper surface to an outer edge of the lower surface, a face height of the face measuring at least about ¼". A method of manufacturing a hat includes: forming a brim, a rear edge of the brim attached to a lower edge of a crown, the brim including an upper surface; a lower surface; and a face, the face extending from an outer edge of the upper surface to an outer edge of the lower surface, a face height of the face measuring at least ¼"; and incorporating face indicia onto the face of the brim.

20 Claims, 15 Drawing Sheets

(56) References Cited

U.S. PATENT DOCUMENTS

| | | | | | |
|---|---|---|---|---|---|
| D349,389 | S | * | 8/1994 | Phillips | D2/893 |
| D384,793 | S | | 10/1997 | Brown | |
| 5,701,607 | A | | 12/1997 | Kaiser | |
| 5,704,070 | A | | 1/1998 | Stogner | |
| D401,738 | S | | 12/1998 | Scerbo | |
| D405,239 | S | | 2/1999 | Kostinko | |
| 5,865,333 | A | | 2/1999 | Wolfe | |
| 5,983,398 | A | | 11/1999 | Kronenberger | |
| D417,334 | S | | 12/1999 | Wands | |
| 6,076,192 | A | * | 6/2000 | Kronenberger | A42B 1/062 2/195.6 |
| 6,158,055 | A | * | 12/2000 | Park | A42B 1/06 112/439 |
| 6,163,888 | A | | 12/2000 | Park | |
| 6,311,331 | B1 | * | 11/2001 | Park | A42B 1/063 2/175.1 |
| 6,370,696 | B1 | | 4/2002 | Kronenberger | |
| 6,588,021 | B2 | * | 7/2003 | Kronenberger | A42B 1/062 2/175.2 |
| RE38,394 | E | | 1/2004 | Morse et al. | |
| 6,721,962 | B1 | * | 4/2004 | Polaire | A42B 1/244 2/209.13 |
| D492,094 | S | | 6/2004 | Park | |
| D499,231 | S | | 12/2004 | Toppel | |
| 6,935,761 | B2 | * | 8/2005 | Vanderschuit | A42B 1/062 362/106 |
| D521,713 | S | | 5/2006 | Cho | |
| 7,073,206 | B2 | | 7/2006 | Yan | |
| 7,168,100 | B2 | * | 1/2007 | Kronenberger | A42B 1/063 2/171.03 |
| 7,178,173 | B2 | | 2/2007 | Kronenberger | |
| D566,380 | S | | 4/2008 | Galvan | |
| D592,834 | S | | 5/2009 | Keiser | |
| 7,581,261 | B2 | | 9/2009 | Cho | |
| D635,743 | S | | 4/2011 | Johnson | |
| D637,797 | S | | 5/2011 | Kim | |
| 7,942,543 | B2 | * | 5/2011 | Ritter | A42B 1/244 315/307 |
| 7,950,068 | B2 | | 5/2011 | Chang | |
| D654,251 | S | | 2/2012 | Alkas-Shamoun | |
| 8,266,722 | B2 | * | 9/2012 | Wang | A42B 1/062 2/195.1 |
| 8,550,651 | B2 | | 10/2013 | Waters | |
| D702,928 | S | | 4/2014 | White | |
| 8,757,831 | B2 | * | 6/2014 | Waters | A42B 1/244 200/566 |
| D709,675 | S | | 7/2014 | Cho | |
| D712,635 | S | | 9/2014 | Rivas | |
| D716,528 | S | | 11/2014 | Badish | |
| 8,973,166 | B1 | | 3/2015 | Engle | |
| D732,803 | S | | 6/2015 | Popovich | |
| 9,049,897 | B2 | | 6/2015 | Kelly et al. | |
| 9,179,720 | B1 | | 11/2015 | Bonadio, Jr. | |
| D774,734 | S | | 12/2016 | Sunness et al. | |
| D778,545 | S | | 2/2017 | Sunness | |
| D778,546 | S | | 2/2017 | Sunness | |
| D778,547 | S | | 2/2017 | Sunness | |
| 2002/0042941 | A1 | | 4/2002 | Grundy | |
| 2004/0194192 | A1 | | 10/2004 | Cho | |
| 2005/0172380 | A1 | | 8/2005 | Turkington | |
| 2006/0174397 | A1 | | 8/2006 | Taguchi | |
| 2007/0022517 | A1 | | 2/2007 | Kronenberger | |
| 2007/0256213 | A1 | * | 11/2007 | Dunavin | A42B 1/069 2/171 |
| 2009/0119819 | A1 | | 5/2009 | Thompson | |
| 2010/0064419 | A1 | * | 3/2010 | Lee | A42B 1/063 2/209.13 |
| 2012/0297522 | A1 | | 11/2012 | Treger et al. | |
| 2014/0338098 | A1 | | 11/2014 | Kelly et al. | |
| 2014/0338103 | A1 | | 11/2014 | Tsai | |

OTHER PUBLICATIONS

Sunness, Brooke Danielle; Notice of Allowance for U.S. Appl. No. 29/526,972, filed May 14, 2015, dated Oct. 6, 2016; 19 pgs.
Sunness, Brooke Danielle; Non-Final Office Action for U.S. Appl. No. 29/526,975, filed May 14, 2015, dated Sep. 7, 2016; 18 pgs.
Sunness, Brooke Danielle; Ex Parte Quayle Action for U.S. Appl. No. 29/526,980, filed May 14, 2015, mailed Sep. 9, 2016, 17 pgs.
Sunness, Brooke Danielle; Ex Parte Quayle for U.S. Appl. No. 29/526,981, filed May 14, 2015, mailed Sep. 7, 2016; 17 pgs.
Sunness, Brooke Danielle; Issue Notification for U.S. Appl. No. 29/526,972, filed May 14, 2015, dated Dec. 7, 2016; 1 pg.
Sunness, Brooke Danielle; Issue Notification for U.S. Appl. No. 29/526,975, filed May 14, 2015, dated Jan. 25, 2017, 1 page.
Sunness, Brooke Danielle; Notice of Allowance for U.S. Appl. No. 29/526,975, filed May 14, 2015, dated Dec. 20, 2016, 9 pgs.
Sunness, Brooke Danielle; Issue Notification for U.S. Appl. No. 29/526,980, filed May 14, 2015, dated Jan. 25, 2017, 1 page.
Sunness, Brooke Danielle; Notice of Allowance for U.S. Appl. No. 29/526,980, filed May 14, 2015, dated Dec. 5, 2016; 7 pgs.
Sunness, Brooke Danielle; Issue Notification for U.S. Appl. No. 29/526,981, filed May 14, 2015, dated Jan. 25, 2017, 1 page.
Sunness, Brooke Danielle; Notice of Allowance for U.S. Appl. No. 29/526,981, filed May 14, 2015, dated Dec. 2, 2016; 9 pgs.
Sunness, Brooke Danielle; U.S. Design Patent Application entitled: Hat With Flat Thick Brim having U.S. Appl. No. 29/526,972, filed May 14, 2015, 6 pgs.
Sunness, Brooke Danielle; U.S. Design Patent Application entitled: Hat With Curved Thick Brim having U.S. Appl. No. 29/526,975, filed May 14, 2015, 6 pgs.
Sunness, Brooke Danielle; U.S. Design Patent Application entitled: Flat Thick Hat Brim having U.S. Appl. No. 29/526,980, filed May 14, 2015, 6 pgs.
Sunness, Brooke Danielle; U.S. Design Patent Application entitled: Curved Thick Hat Brim having U.S. Appl. No. 29/526,981, filed May 14, 2015, 6 pgs.
Article entitled: "Baseball Cap", located at http://www.madehow.com/Volume-4/Baseball-Cap.html>, accessed on May 20, 2015, 5 pgs.
Thread2Head; Article entitled "Customized Cap Bill", located at http://thread2head.com/?p=421>, accessed on Apr. 16, 2015, 2 pgs.
Sunness, Bob Robert; International Search Report and Written Opinion for Application No. PCT/US15/60794, filed Nov. 16, 2015, dated Jan. 28, 2016, 8 pgs.
Sunness, Bob Robert; PCT Application entitled: Hat With Thick Brim Face having serial No. PCT/US15/60794, filed Nov. 16, 2015, 42 pgs.
On Scene, Inc. Base Ball Hats/Caps. Archived copy from Feb. 25, 2015 [retrieved on Jan. 7, 2016] Retrieved from the Internet: <URL: https://web.archive.org/web/20150225044400/http:/www.onsceneinc.com/baseball-hats-caps/> entire document, 9 pgs.
THiiK, LLC; Office Action for Canadian Application No. 165,332, filed Nov. 13, 2015, dated Feb. 9, 2016, 4 pgs.
Sunness, Brooke Danielle; Applicant Initiated Interview Summary for U.S. Appl. No. 29/526,972, filed May 14, 2015, dated Apr. 15, 2016, 4 pgs.
Sunness, Brooke Danielle; Non-Final Office Action for U.S. Appl. No. 29/526,972, filed May 14, 2015, dated Mar. 23, 2016, 15 pgs.
THiiK, LLC; Office Action for Mexican Application Serial No. MX/f/2015/003447, filed Nov. 13, 2015, dated Jun. 20, 2017, 5 pgs.
Sunness, Bob Robert; International Preliminary Report on Patentability for Application No. PCT/US15/60794, filed Nov. 16, 2015, dated Jan. 4, 2018, 7 pgs.

* cited by examiner

HAT WITH THICK BRIM FACE

TECHNICAL FIELD

This disclosure relates to headgear. More specifically, this disclosure relates to brims on hats and caps.

BACKGROUND

A user of a hat has a number of options for simply covering his or her head or for shading a portion thereof. For a user of a hat with a brim and a crown to communicate information on the hat visually through the placement of graphics such as text or artwork, though, he or she is limited to those surfaces of the hat which will accommodate such information, such as the surfaces of the crown and the upper and lower surfaces of the brim. There is a limit to how much information can be incorporated into or onto these surfaces, and there is also a limit to how much of that information can actually be accurately read and comprehended from a distance.

SUMMARY

Disclosed is a hat brim including: an upper surface; a lower surface; and a face, the face extending from an outer edge of the upper surface to an outer edge of the lower surface, a face height of the face measuring at least about ¼".

Also disclosed is a hat including: a crown; and a brim, the brim including an upper surface; a lower surface; and a face, the face extending from an outer edge of the upper surface to an outer edge of the lower surface, a face height of the face measuring at least about ¼".

Also disclosed is a method of manufacturing a hat including: forming a brim, a rear edge of the brim attached to a lower edge of a crown, the brim including an upper surface; a lower surface; and a face, the face extending from an outer edge of the upper surface to an outer edge of the lower surface, a face height of the face measuring at least about 3/16"; and incorporating face indicia onto the face of the brim.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a thick hat brim and associated methods, systems, devices, and various apparatus. The thick hat brim includes an upper surface, a lower surface, and a face. In various embodiments, the thick hat brim also includes a crown to form a hat. It would be understood by one of skill in the art that the disclosed thick hat brim is described in but a few exemplary embodiments among many. No particular terminology or description should be considered limiting on the disclosure or the scope of any claims issuing therefrom.

Figure 1:
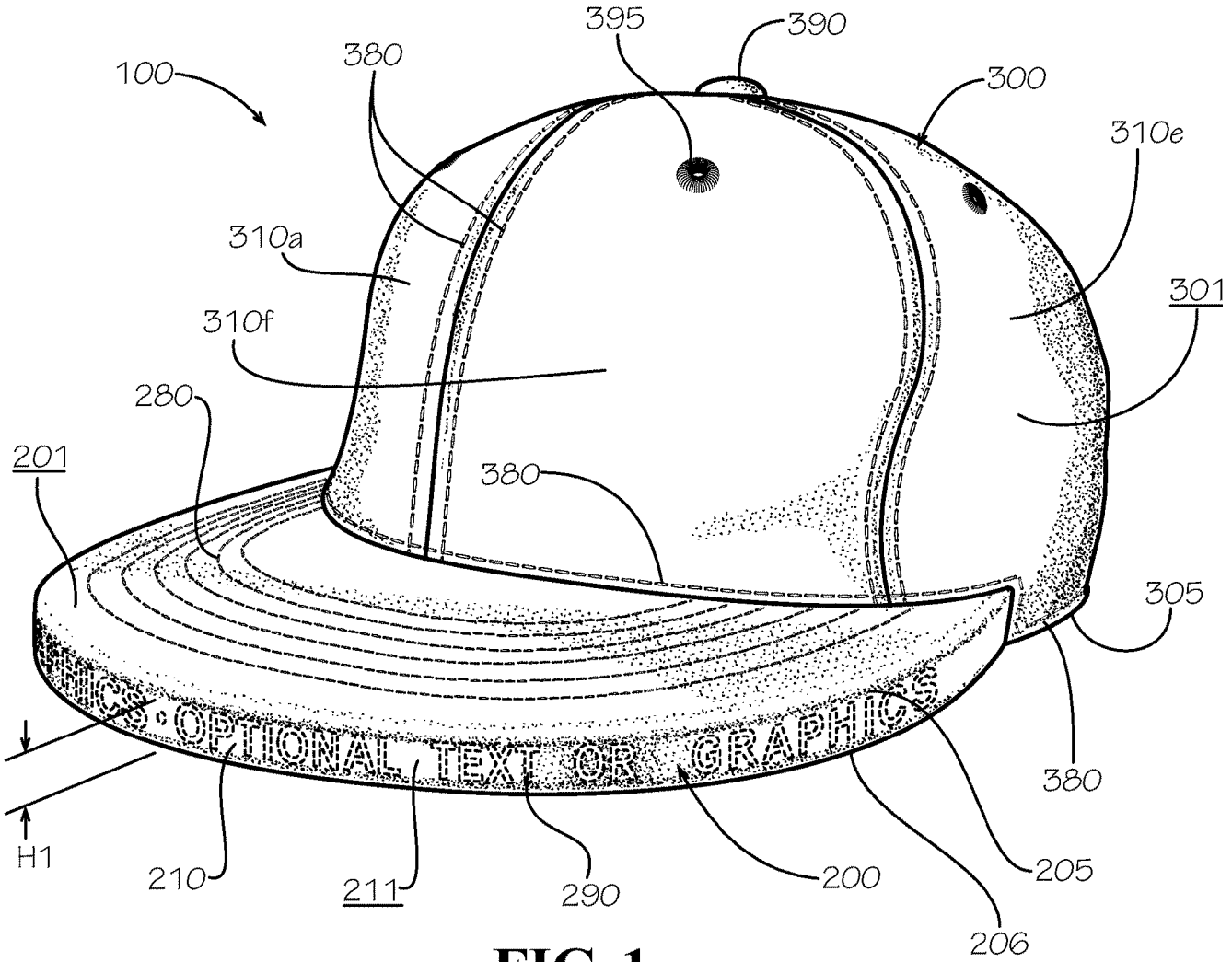
FIG. 1 is a perspective view of a hat with a flat brim in accordance with one embodiment of the current disclosure.

FIG. 1 discloses one embodiment of a hat 100. In various embodiments, the hat 100 includes a brim 200 and a crown 300. In various embodiments, the brim 200 extends from only one side of the crown 300 such as in the case of a baseball cap, a golf hat, a jockey hat, a baseball helmet, or any other hat with a brim that shades just a portion of the user's head. The disclosure of a hat 100 with a brim 200 that extends from only one side of the crown 300, however, should not be considered limiting on the current disclosure.

The brim 200 defines an upper surface 201, a lower surface 202 (shown in FIG. 3), and a face 210. The face 210 defines a face surface 211. In various embodiments, the face 210 also defines face indicia 290. Face indicia 290 may be text as shown or may be any graphical display, with or without discernable text.

The brim 200 also defines a face height H1 between an outer edge 205 of the upper surface 201 and an outer edge 206 of the lower surface 202. In various embodiments, the brim 200 defines a slight radius at the outer edge 205 or the outer edge 206 or in both locations. In various embodiments, the brim defines no discernable radius at the outer edge 205 or at the outer edge 206 or has a radius that is more pronounced than shown. In various embodiments, the brim 200 includes stitching 280, shown in the current embodiment in the upper surface 201. In various embodiments, the lower surface 202 includes stitching 282 (shown in FIG. 3).

In various embodiments, a thickness T (shown in FIG. 11) or the face height H1 of the brim 200 or the use of the face indicia 290 provides aesthetic or functional benefits or both to the user or the viewer of a hat such as the hat 100. In various embodiments, a hat brim face such as the face 210 of the brim 200 provides a surface that is of a unique shape compared to other surfaces of the hat (the upper surface 201 and lower surface 202 of the brim 200 and the outer surface 301 of the crown, for example). The face surface 211 has a shape that can accommodate an endless variety of text or other graphical elements for advertising or for the benefit of the user or the viewer of the hat by communicating a particular message or a particular look or both. In various embodiments including but not limited to that shown in FIG. 21, the brim 200 is that part of the hat 100 that is closest to the viewer and that also contains a surface—the face surface 211—that most directly faces the viewer and as a result is more easily legible or viewable than other surfaces of the hat 100. Other surfaces of the hat 100 including the upper surface 201 and lower surface 202 of the brim 200 and the outer surface 301 of the crown face at least partly or completely away from the viewer of the hat and therefore must be viewed from an angle, if they can be viewed at all. When viewed at an angle, the text or graphics may be distorted or otherwise obscured.

The crown 300 of the hat 100 is formed from a plurality of panels 310*a-f* (310*b-d* shown in FIG. 2), each of which may be uniquely shaped, sewn together with stitching 380. The crown 300 includes an outer surface 301 and a lower edge 305. The crown 300 may also include one or more eyelets 395. In various embodiments, however, no eyelets 395 will be included in a hat such as the hat 100. In the current embodiment, one eyelet 395 is included in an upper portion of each panel 310. In various embodiments, the crown 300 includes a button 390.

Figure 2:
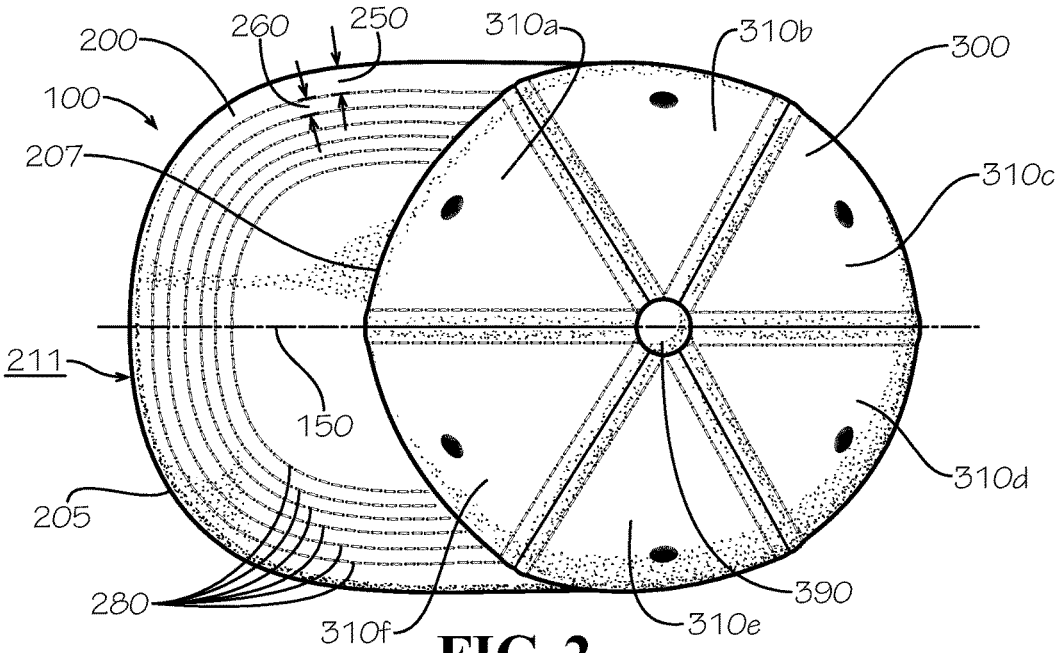
FIG. 2 is a top view of the hat of FIG. 1.

FIG. 2 discloses the crown 300 of the hat 100 as including the six panels 310*a-f*, each panel 310 held to an adjacent panel by a portion of tape 394*a-c* (shown in FIG. 3) and the stitching 380. However, the disclosure of six panels 310*a-f* should not be considered limiting on the current disclosure. In various embodiments, the crown 300 is formed from fewer than or more than the six panels 310*a-f* and can be formed even from a single panel that is formed, molded, or cut into the desired shape. In various embodiments, adjacent panels 310 may be joined without the tape 394 or without the stitching 380. Also visible in FIG. 2 is the upper surface 201 of the brim 200 with stitching 280. In the current embodiment, stitching 280 includes six separately discernable lines of stitching 280, the outermost line of stitching 280 offset from an intersection between the face surface 211 and the upper surface 201 at the outer edge 205 by an offset distance 250, which is ⅞" (22.2 mm) in various embodiments in which the face height H is equal to approximately ⅜". In various embodiments, each line of stitching 280 is separated from an adjacent line of stitching 280 by a separation distance 260, which is 3/16" (4.8 mm) in various embodiments. This particular stitching arrangement, however, should not be considered limiting on the current disclosure. The stitching 280, as will be discussed below, may provide either a functional purpose or an aesthetic purpose or both. In various embodiments, the stitching 280 is not visible after assembly of the hat 100 or is left off altogether from the brim 200. In various embodiments, the brim 200 when viewed from the top or from the bottom defines in a horizontal plane coplanar with the upper surface 201 a radius of curvature on an inner edge 207 of the upper surface 201 where the brim 200 meets the crown 300. In various embodiments, the brim 200 defines in a horizontal plane coplanar with the upper surface 201 one or more radii of curvature on the outer edge 205 of the upper surface 201.

Figure 3:
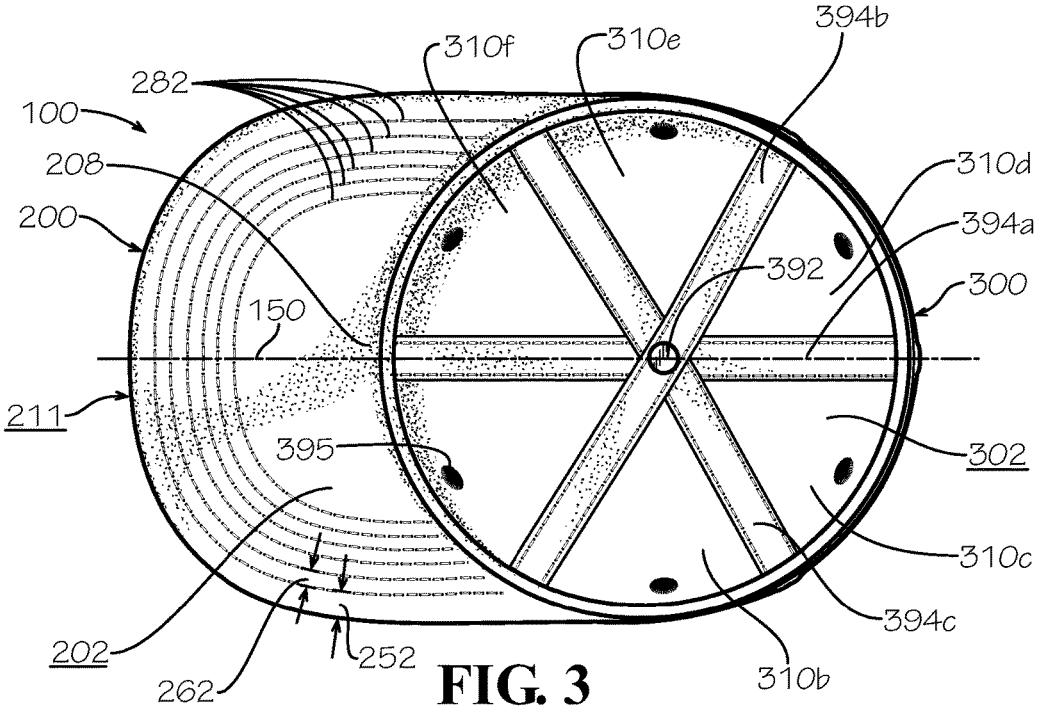
FIG. 3 is a bottom view of the hat of FIG. 1.

FIG. 3 discloses the hat 100 viewed from a direction facing the lower surface 202 of the brim 200 and facing an inner surface 302 of the crown 300. The reverse side of each of a plurality of eyelets 395 is shown in FIG. 3, as well as the reverse side of each of the plurality of panels 310, the plurality of tapes 394*a-c*, and a fastener 392 of the button 390 all together defining the inner surface 302. The lower surface 202 of the brim 200 is shown with stitching 282. In the current embodiment, the stitching 282 includes six separately discernable lines of stitching 282, the outermost line of stitching 282 offset from an intersection between the face surface 211 and the lower surface 202 at the outer edge 206 by an offset distance 252, which may be similar in length to that of the offset distance 250. In various embodiments, each line of stitching 282 is separated from an adjacent line of stitching 282 by a separation distance 262, which may be similar in length to that of the separation distance 260. This particular stitching arrangement, however, should not be considered limiting on the current disclosure. The stitching 282, similarly to the stitching 280, may provide either a functional purpose or an aesthetic purpose or both. In various embodiments, the stitching 282 is not visible after assembly of the hat 100 or is left off altogether from the brim 200. In various embodiments, the hat is symmetrical about a vertical plane of symmetry 150 drawn through the center of the brim 200 and through the crown 300. In various other embodiments, however, the hat is not symmetrical about a vertical plane of symmetry 150 and the disclosure of a hat 100 symmetrical about a vertical plane of symmetry 150 should not be considered limiting on the current disclosure.

Figure 4:
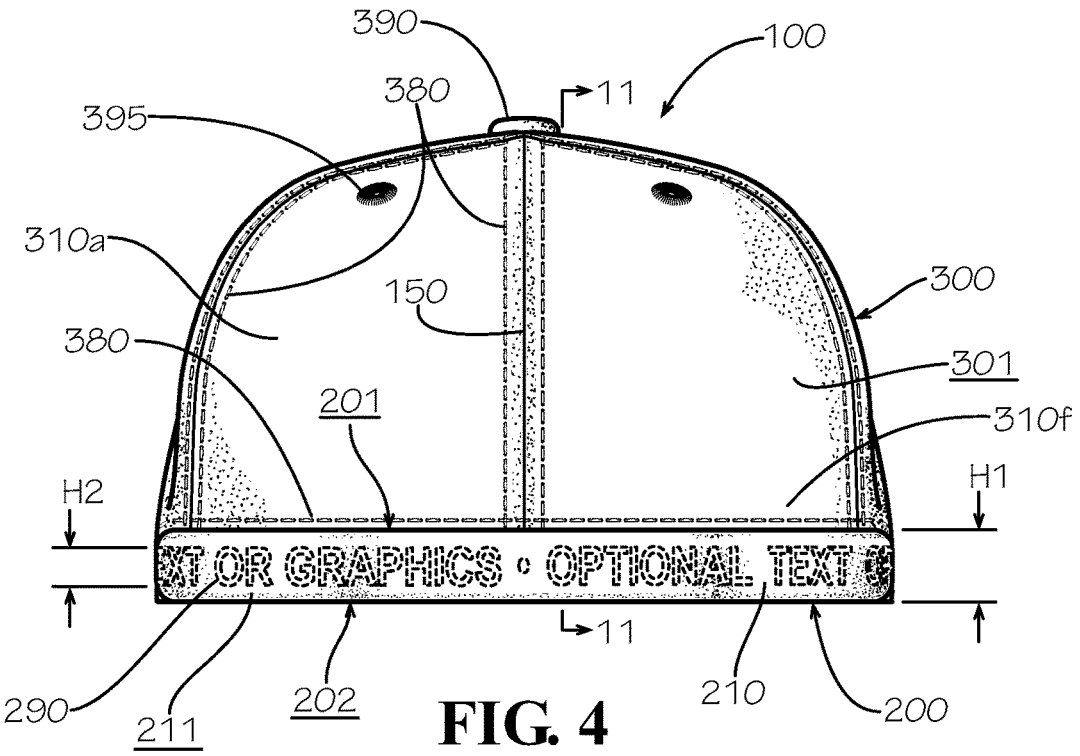
FIG. 4 is a front view of the hat of FIG. 1.

FIG. 4 discloses a front view of the hat 100. In various embodiments, the face indicia 290 have an indicia height H2 that is smaller than the face height H1. In various embodiments, the indicia height H2 is constant. The disclosure of a constant indicia height H2 should not be considered limiting on the current disclosure, however, as some portions of the face indicia 290 may have an indicia height that is less than or greater than the indicia height H2. In various embodiments, the face indicia 290 shown in broken lines is represented by the following upper-case English text: "OPTIONAL TEXT OR GRAPHICS." The disclosure of all upper-case text, text in the English language, or any text at all should not be considered limiting on the current disclosure, however. In various embodiments, the face indicia 290 will include lower-case text or text in another language or will not include any discernable text at all.

Figure 5:
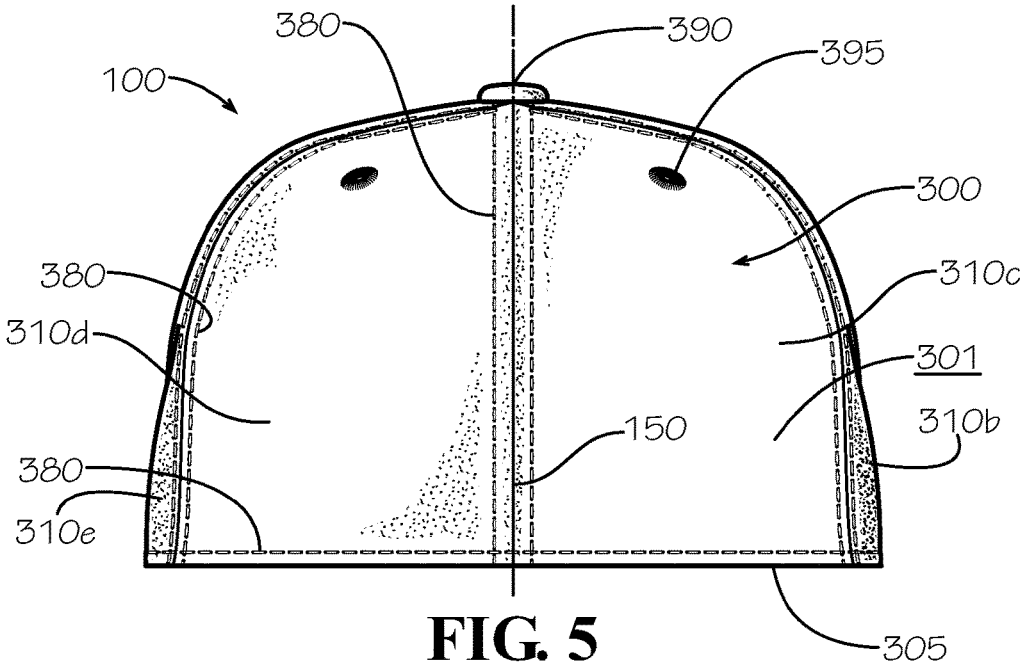
FIG. 5 is a rear view of the hat of FIG. 1.

FIG. 5 discloses a rear view of the hat 100. In various embodiments, the panels 310*a-f* of the crown 300 form a rear portion of the crown 300 that is completely closed. For purposes of the current disclosure, for the rear portion of the crown 300 to be "completely closed" means that the rear portion of the crown 300 defines no opening between the outer surface 301 and the inner surface 302 with the exception of the openings defined by eyelets 395. In various embodiments, however, at least one of which will be described hereafter, the rear portion of the crown 300 will not be completely closed.

Figure 6:
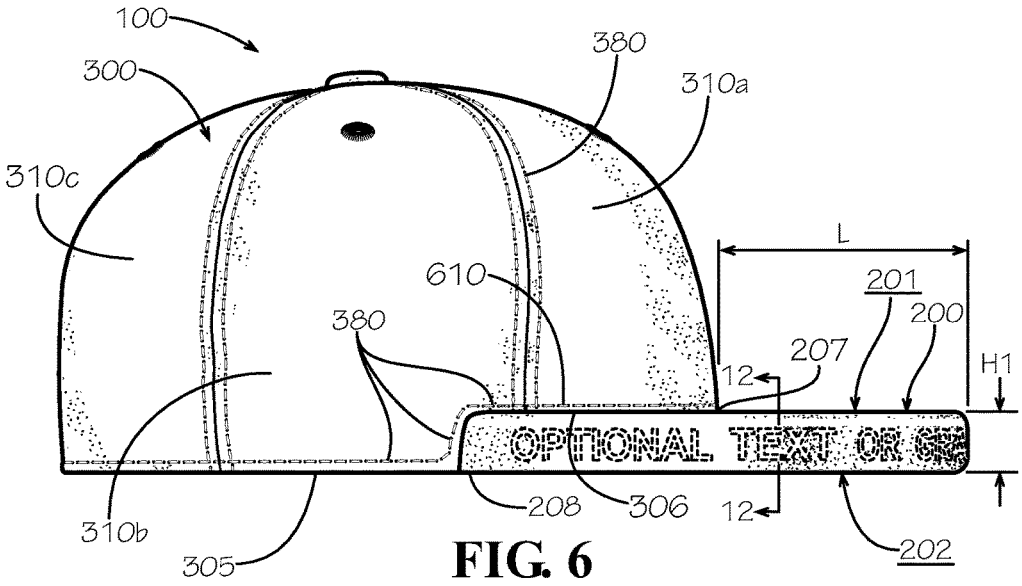
FIG. 6 is a side view of the hat of FIG. 1.

FIG. 6 discloses a side view of the hat 100. In various embodiments, the lower surface 202—or a portion of the lower surface 202 such as the inner edge 208—of the brim 200 is flush with the lower edge 305 of the crown 300. In such embodiments, a front portion 306 of the lower edge 305 of the crown 300, or the stitching 380 that is offset from the lower edge 305 of the hat 100 and that extends around the bottom of the hat 100, or a lower portion 610 of the stitching 380 that is offset from the brim 200 follows the profile of the brim 200 in the area where the brim 200 is connected to the crown 300. The brim 200 is shown as extending a brim length L from the inner edge 207 of the upper surface 201—or from a front edge of the crown 300—along the plane of symmetry 150. In various embodiments, the brim length L will equal between 27% and 30% of the overall length of the hat 100 measured along the same plane of symmetry 150, though other percentages may be present in various other embodiments and the disclosure of between 27% and 30% should not be considered limiting on the current disclosure.

Figure 7:
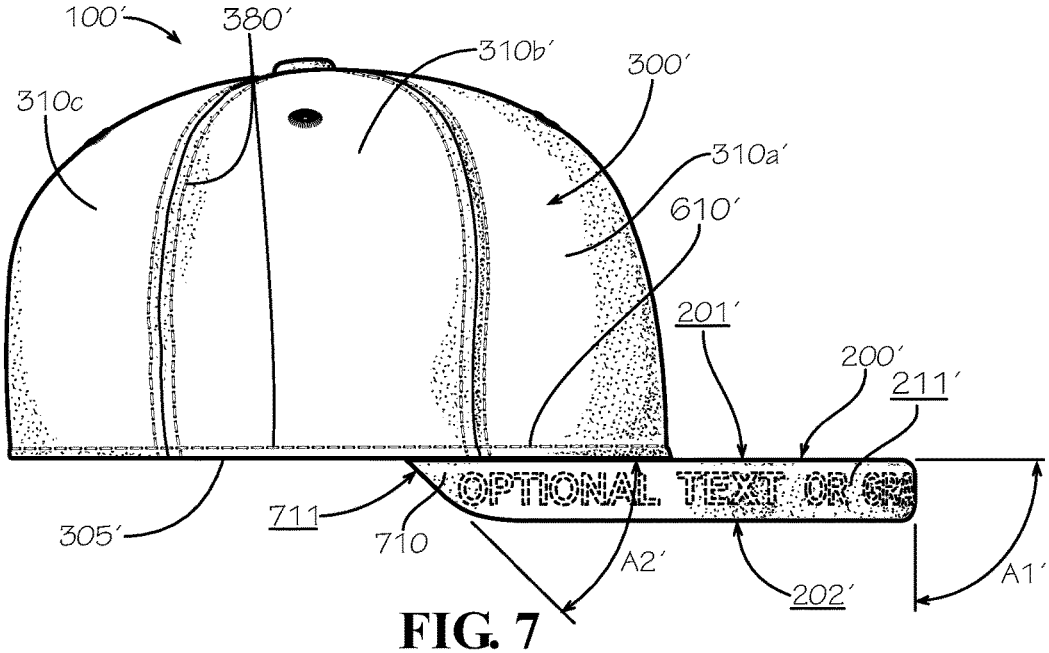
FIG. 7 is a side view of a hat of FIG. 1 with a flat brim in accordance with another embodiment of the current disclosure.

In various embodiments including a hat 100' disclosed in FIG. 7, a lower surface 202'—or a portion of the lower surface 202'—of the brim 200' is shown offset from a lower edge 305' of the crown 300. In such embodiments, a stitching 380' that is offset from the lower edge 305 of the hat 100 and that extends around the bottom of the hat 100 and a lower portion 610' of the stitching 380' that is offset from the brim 200 is level around the full circumference of the hat 100 (as shown in FIG. 7), and the lower edge 305' itself is level around the full circumference of the hat 100. In various embodiments, both the upper surface 201 and the lower surface 202 are offset from the lower edge 305. In various embodiments, the upper surface 201 and the lower surface 202 are offset from the lower edge 305 in opposite directions. In various embodiments, a lower edge of the crown such as the lower edge 305' or stitching around the bottom of the hat such as the stitching 380 follows the profile of the brim 200 in the area where the brim 200 is connected to the crown 300. In various embodiments, the brim 200' includes a tapered portion 710 where the brim 200' connects to the crown 300'. An angle A1' describes the angle in cross-section between an upper surface of a brim such as the upper surface 201' of the brim 200' and a face surface such as the face surface 211'. An angle A2' describes the angle in cross-section between an upper surface of a brim such as the upper surface 201' of the brim 200' and a tapered surface of a tapered portion such as a tapered surface 711 of the tapered portion 710.

Figure 8:
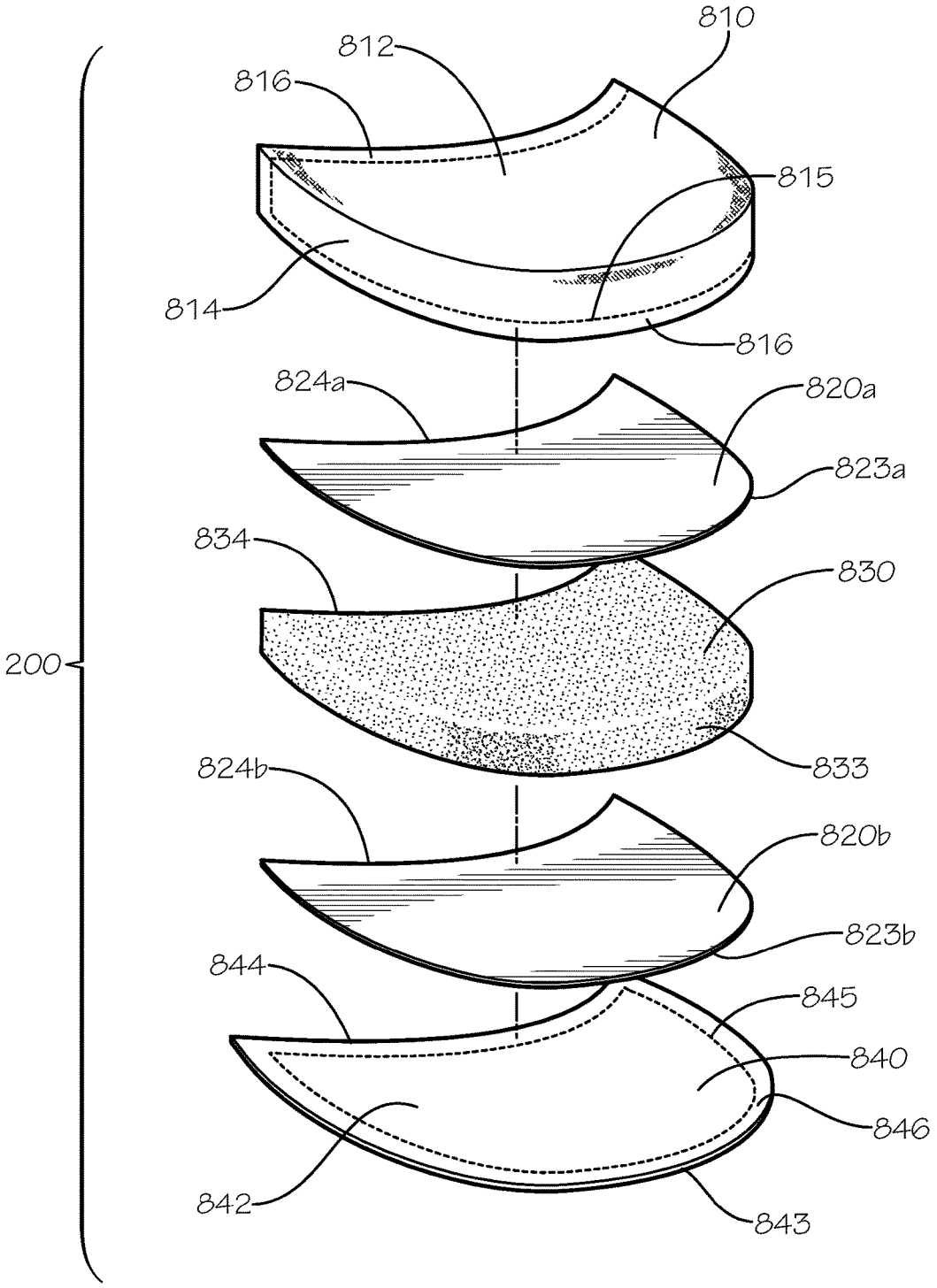
FIG. 8 is a perspective exploded view of the brim of the hat of FIG. 1.

FIG. 8 discloses components of the brim 200 in an exploded arrangement before assembly of the brim 200. In various embodiments, the brim 200 includes an upper cover 810 and a lower cover 840. In various embodiments, the brim 200 includes one or more surface inserts 820 and one or more core inserts 830 sandwiched between the upper cover 810 and the lower cover 840. In various embodiments, the brim 200 requires no surface inserts 820 or no core inserts 830. In various embodiments, a single core insert such as the core insert 830, which may be solid or may be partially hollow, fills the space between the upper cover 810 and the lower cover 840. In the current embodiment, there are two surface inserts 820*a,b* and one core insert 830. In various embodiments, the brim 200 includes any one of numerous possible combinations of quantities and thicknesses of each layer of material. One or more layers may be absent in an embodiment, or a layer such as the covers 810,840, the surface inserts 820*a,b*, or the core insert 830 may actually include multiple layers even though disclosed as only one layer in the current embodiment. In various embodiments of an interior structure of the brim not including the covers 810,840, a plastic core insert may be sandwiched between two or more pieces of layered fabric, between two or more pieces of foam sheet, or between two or more pieces of both layered fabric and foam sheet.

In various embodiments, adhesive is used to assemble one or more pairs of mating surfaces of the aforementioned components of a brim such as the brim 200. In various other embodiments, adhesive is not used in constructing the brim 200. In various embodiments, with or without adhesive, stitching (not shown in FIG. 8 but shown in figures showing the assembled hat) is used to assemble one or more components of the brim.

The brim components shown in FIG. 8 need not be assembled to each other simultaneously in a single step. In various embodiments, the surface insert 820*a* is assembled to the upper cover 810 before assembly of the upper cover 810 to the lower cover 840 or before the incorporation of the core insert 830 or both. In various embodiments, the surface insert 820*b* is assembled to the lower cover 840 before assembly of the upper cover 810 to the lower cover 840 or before the incorporation of the core insert 830 or both. The stitching 280 (shown in FIG. 1) may be incorporated into the initial assembly of the surface insert 820*a* to the upper cover 810, and the stitching 282 (shown in FIG. 3) may be incorporated into the initial assembly of the surface insert 820*b* to the lower cover 840.

FIG. 8 discloses the upper cover 810 as pre-formed and including a horizontal panel 812, a vertical flange 814, and a thickness; the lower cover 840 as including a horizontal panel 842, an outer edge 843, an inner edge 844, and a thickness; the surface insert 820*a* as including an outer edge 823*a*, an inner edge 824*a*, and a thickness; the surface insert 820*b* as including an outer edge 823*b*, an inner edge 824*b*, and a thickness; and the core insert 830 as including an outer edge 833, an inner edge 834 (shown in FIG. 11), and a thickness. In various embodiments, the upper cover 810 includes a connection flange 816 starting at a line 815 on the vertical flange 814. In various embodiments, the lower cover 840 includes a connection flange 846 starting at a line 845 on the horizontal panel 842. The connection flange 846 may also be described as a seam allowance. In various embodiments, the connection flanges 816,846 are hidden in the assembled brim 200. In various embodiments, the brim 200 is assembled without the need for connection flanges 816, 846. In various embodiments, the connection flange may measure approximately 0.25" (6.4 mm) in length at an outer edge such as the outer edge 843. In various embodiments, the connection flange may measure approximately 0.5" (12.8 mm) in length at an inner edge such as the inner edge 844.

Figure 9:
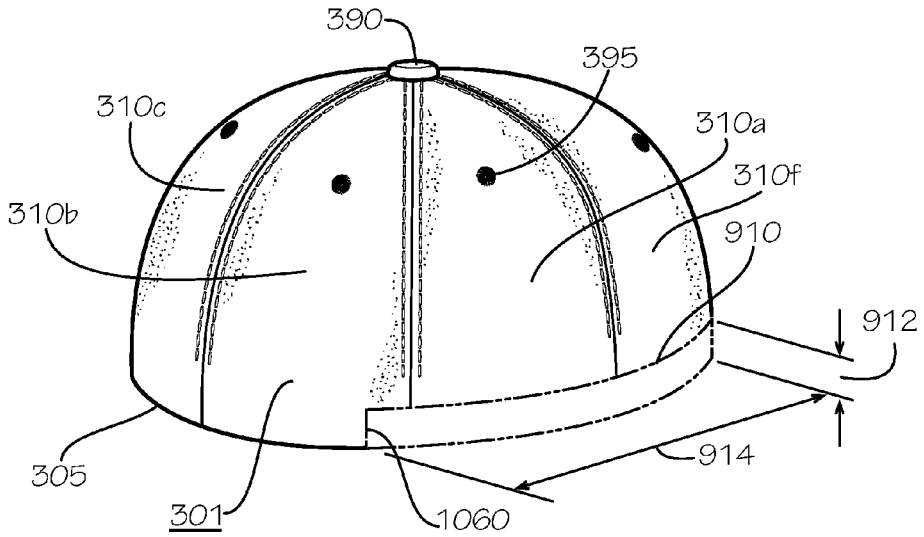
FIG. 9 is a perspective view of the crown of the hat of FIG. 1.

FIG. 9 discloses the crown 300 of the hat 100 before attachment of the brim 200 to the crown 300. A height 912 and a width 914 of a notch 910 defined in the crown 300 are sized to receive the brim 200. Extra material extending below the bottom of the panels 310 that may be hemmed during assembly of the hat 100 to create a hemmed seam or other clean connection at the bottom of the crown 300 is present in some embodiments but is not shown for clarity.

Figure 10:
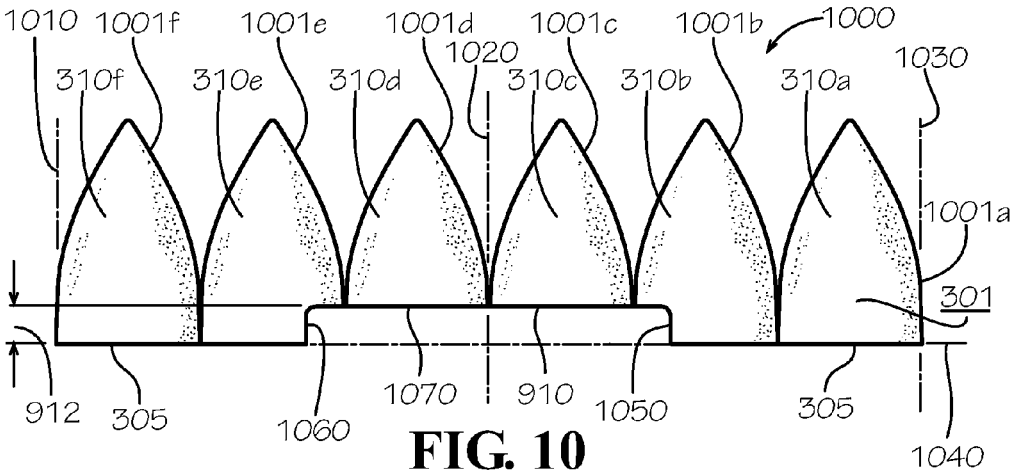
FIG. 10 is a plan view of a blank of the crown of the hat of FIG. 1.

FIG. 10 discloses a blank 1000 of the crown 300 of the hat 100. An edge 1020 represents the center front of the crown 300 where two adjacent panels 310*c* and 310*d* are joined during assembly. An edge 1010 and an edge 1030 represent edges of two other adjacent panels 310*a* and 310*f* that are joined during assembly to form the center rear of the crown 300. In various embodiments, extra material (not shown) at the outer edge 1001*a-f* of each panel 310*a-f* is used to join the adjacent panels 310*a-f* and is later hidden in various embodiments by the tapes 394*a-c*. In various embodiments, the panels 310*a-f* included in the blank 1000 are separate pieces of raw material that are joined to produce the blank 1000 from which the crown 300 is constructed. In various other embodiments, the panels 310*a-f* included in the blank 1000 are formed or cut from a single piece of raw material. In various embodiments, the blank 1000 defines a notch such as the notch 910. The notch 910 includes an edge 1070 shaped to match the shape of the brim 200 where the brim is connected to the crown 300. In various embodiments, the notch 910 also includes a pair of vertical edges 1050,1060, wherein each is shaped to match the shape of the brim 200 where the brim is connected to the crown 300. In various embodiments, extra material (not shown) extending beyond the lower edge 305 of the crown 300 or beyond the edges 1050,1060,1070 is used during the assembly process to create a hemmed or otherwise clean edge.

Figure 11:
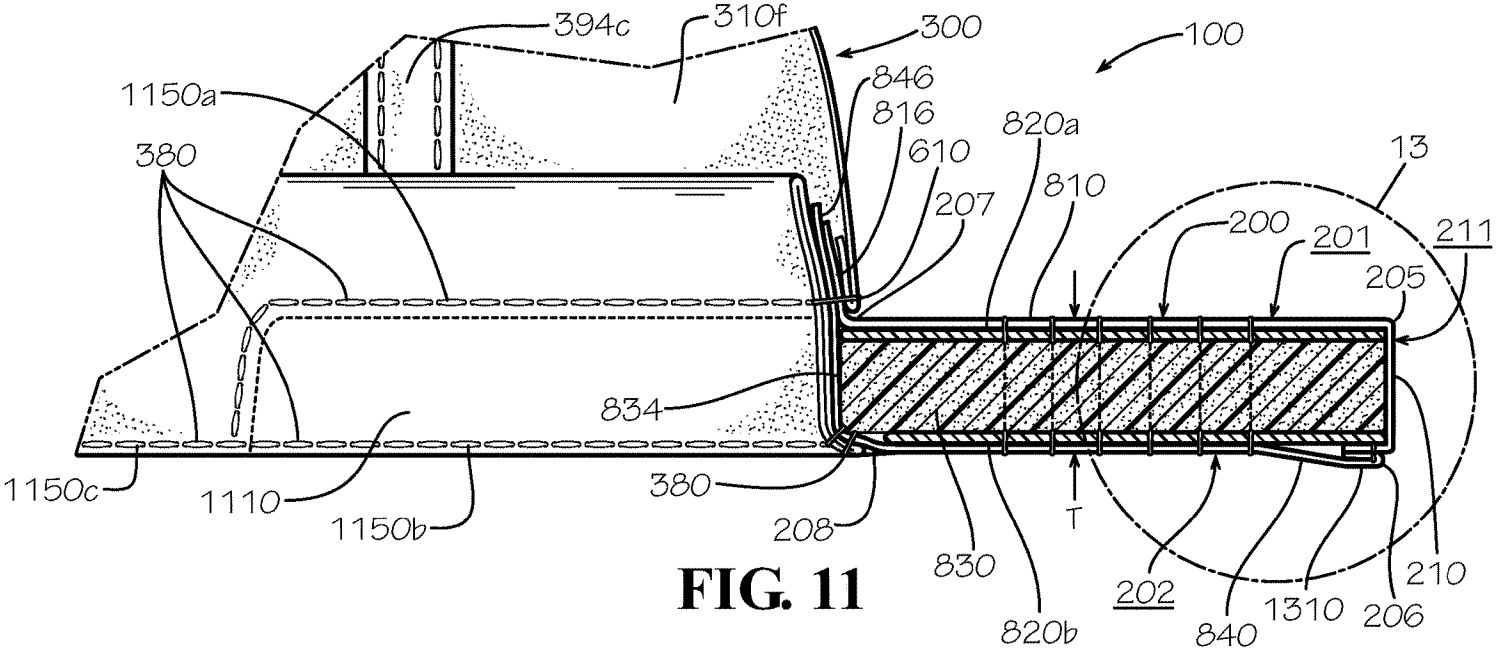
FIG. 11 is a sectional view of the hat of FIG. 1 taken along lines 11-11 of FIG. 4.

FIG. 11 discloses the internal structure of the hat 100 including the brim 200 and the connection of the brim 200 to the crown 300 when the internal structure is viewed from the side. In various embodiments, the material forming the upper cover 810 and the material forming the lower cover 840 are sized to envelope or cover the core insert 830 with surface inserts 820*a,b* sandwiched in-between. In various embodiments, the material forming the upper cover 810 and the material forming the lower cover 840 are sized to also include connection flanges 816,846 on covers 810,840, respectively, to which the crown 300 and a sweatband 1110 are sewn along a stitching line 1150*a* with a front portion 610 of the stitching 380. In various embodiments, stitching 380 is also included to join the sweatband 1110 to the lower cover 840 along a stitching line 1150*b*. In various embodiments, stitching 380 is included to join the sweatband 1110 and the lower edge 305 of the crown 300 along a stitching line 1150*c*. In various embodiments, the result of this joining the sweatband 1110 to the lower edge 305 of the crown 300 will result in a hemmed or otherwise "clean" or smooth lower edge 305. In various embodiment, one or more additional lines of stitching 380 will join the sweatband 1100 to the lower cover 840 or to other portions of the brim 200 or crown 300. In various embodiments, the sweatband 1110 is a tubular piece of material that is flattened before or during assembly. The sweatband 1110 may also be a flat piece of material that is hemmed at the top and at the bottom to produce a clean edge and, in various embodiments, a constant thickness sweatband.

In various embodiments, the upper cover 810 and the lower cover 840 are joined at the outer edge 206 of the lower surface 202 by a joint 1310 which in the current embodiment is a sewn joint. However, the disclosure of a sewn joint for the joint 1310 should not be considered limiting on the current disclosure as the joint 1310 may or may not require a sewn connection. Furthermore, a joint such as the joint 1310 may include adhesive materials or other fastening materials in various embodiments. In various embodiment, the joint 1310 may include not only the hidden portions of the connection of the two components but also the visible portions, and vice versa. In various embodiments for aesthetic or other reasons, some or all of the stitching or other elements of the joint 1310 will not be directly visible on an assembled hat. Placing some or all of the stitching of the join 1310 on the inside of the brim 200 will produce a clean finish that is desirable to some users.

In various embodiments, a face such as the face 210 and particularly the face surface 211 of a brim such as the brim 200 is continuous in that the face 210 and the face surface 211 are unbroken or uninterrupted by seams or joints except for a joint such as the joint 1310 at the outer edge 205 or at the outer edge 206. In various embodiments where the face surface 211 is continuous, face indicia such as the face indicia 290 are readily incorporated into the face 210 and also legible from a distance. In various other embodiments where the face surface 211 is not continuous, face indicia such as the face indicia 290 are also readily incorporated into the face 210 and also legible from a distance. In various embodiments, a face such as the face 210 of a brim such as the brim 200 is substantially flat in cross section in that the face 210 and the face surface 211 are smooth and even and free of any protrusions or indentations including those that might affect the manufacturability or the legibility of any face indicia such as the face indicia 290 incorporated into the face 210. In various embodiments, the only protrusions or indentations will be those resulting from the texture of the material forming a cover such as the cover 810, those resulting from the incorporation of any face indicia such as the face indicia 290, and those resulting from the incorporation of a joint such as the joint 1310. In various embodiments, any protrusions or indentations on the face 210 or on the face surface 211 do not affect the manufacturability or the legibility of any face indicia such as the face indicia 290 incorporated into the face 210. In various embodiments, the face indicia 290 are printed or embroidered or otherwise incorporated into or onto the face surface 211 in such a way as to cover some or all of the face surface 211. In various embodiments, placing a mesh layer (not shown) inside the brim 200 behind the face 210 to stiffen the face 210 or the brim 200 allows embroidered or printed face indicia to be applied to the brim 200 more consistently or to resist degradation over time due to repetitive use of the hat 100.

In various embodiments, an insert such as the surface inserts 820*a,b* or the core insert 830 extends from the inner edge 207 of the upper surface 201 to the outer edge 205 of the upper surface. In various embodiments, an insert such as the surface inserts 820*a,b* or the core insert 830 extends from the inner edge 208 of the lower surface 202 to the outer edge 206 of the lower surface 202. In various embodiments, an insert such as the surface inserts 820*a,b* or the core insert 830 stops short of either the outer edge 205, the outer edge 206, the inner edge 207, or the inner edge 208. In various embodiments, an insert such as the surface inserts 820*a,b* or the core insert 830 does not extend without interruption from the inner edge 207 to the outer edge 205 or from the inner edge 208 to the outer edge 206.

In various embodiments, the upper surface 201 and the lower surface 202 define a thickness T of the brim 200, where the thickness T is substantially constant from an inner edge 207 of the brim 200 to an outer edge 205 of the brim 200. For purposes of the current disclosure, a substantially constant thickness is a thickness that varies only within an acceptable manufacturing tolerance or that does not increase or decrease from an inner edge to an outer edge of the brim 200. In various embodiments, the thickness T of the brim 200 is equal to the face height H1. In various other embodiments, the thickness T of the brim 200 measures more than or less than the face height H1 due to the presence of one or more joints 1310 at the outer edges 205,206. A constant thickness brim will be desirable to some users but should not be considered limiting on the current disclosure. In various other embodiments, the face height H2 is greater than or less than the thickness T of a particular brim. In various embodiments, the thickness T increases or decreases gradually from the inner edge 207 or the inner edge 208 to the outer edge 205 or the outer edge 206, respectively, or to at least a portion of the outer edge 205 or the outer edge 206. The thickness T may, therefore, not be constant in various embodiments.

In various embodiments, an insert such as the core insert 830 includes foam or is formed from a foam material. The foam material may be of an open-cell or a closed-cell variety and may include, but is not limited to, natural and synthetic foam materials and any other sponge-like materials. In various embodiments, the material used to form the core insert 830 is a cellulose material or a cork material. In various embodiments, the material used to form the surface inserts 820*a,b* or the core insert 830 has "memory" causing it to tend to return to its original shape after bending. In various other embodiments, the material does not have such memory but rather retains its new shape. In various embodiments, a material having memory is desirable by a user for at least the reason that such a material can resist undesirable or unintentional deformation of the hat 100. In various embodiments, a material having no memory is desirable by a user for at least the reason that such a material can be bent to achieve a curvature that suits personal taste or some practical function of the user. In various embodiments, the core insert 830 is formed at least partly from a material having a maximum density of one pound per cubic foot (sixteen pounds per cubic meter). The disclosure of a material having a maximum density of one pound per cubic foot, however, should not be considered limiting on the current disclosure. In various embodiments, the core insert 830 measures about 0.2175" (5.5 mm) thick.

In various embodiments, the cover 810 or the cover 840 is formed at least partly from a fabric material such as wool, cotton, or any one or more of number of other fabric materials. The disclosure of a fabric material, however, should not be considered limiting on the current disclosure. In various embodiments, the cover 810 or the cover 840 is formed at least partly from a group of other materials including, but not limited to, natural and synthetic leathers, foams, papers or paper-based products, flexible or rigid plastics, and metals. In various embodiments, a "buckram" stiff cloth material is incorporated as a stiffener into one or more elements of the hat 100.

In various embodiments, the surface inserts 820*a,b* are formed at least partly from a plastic material. The plastic material may be flexible or rigid. In the current embodiment, the surface inserts are formed from a polyvinylchorate (PVC) or high-density polyethylene (HDPE) material or compound that is 0.059" (1.5 mm) thick. The disclosure of a plastic material, however, should not be considered limiting on the current disclosure. In various embodiments, the surface inserts 820*a,b* are formed at least partly from a group of other materials including, but not limited to, natural and synthetic leathers, foams, papers or paper-based products, and metals. In various embodiments, one or more of the materials used to form the covers 810,840, the core insert 830, or the surface inserts 820*a,b* are hydrophobic in that they do not readily absorb water, if at all.

Figure 12:
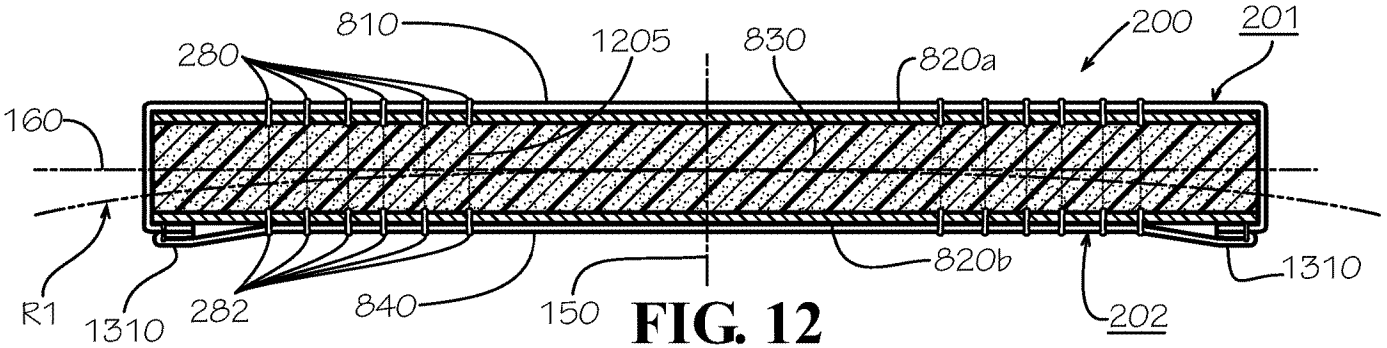
FIG. 12 is a sectional view of the hat of FIG. 1 taken along lines 12-12 of FIG. 6.

FIG. 12 discloses internal structure of the brim 200 of the hat 100 when the internal structure is viewed from the front. In various embodiments, the stitching 280 in the upper surface 201 will only connect the upper cover 810 and the surface insert 820*a*, and the stitching 282 in the lower surface 202 will only connect the lower cover 840 and the surface insert 820*b*, although the stitching may be aligned as shown by the dashed lines 1205 to make it appear that the stitching extends through the thickness of the brim 200, which is equal to the face height H1 in various embodiments. As previously described, the structure of the hat 100 including the brim 200 is symmetrical about a plane of symmetry 150 in various embodiments. If flexible materials are used for each component of the brim 200 in various embodiments, the brim 200 may be allowed to flex so as to form a radius of curvature R1 in the previously flat brim 200 substantially aligned with a horizontal axis 160. In various other embodiments where the brim 200 includes more rigid materials, the brim 200 may be rigid such that it cannot flex or cannot flex permanently.

Figure 13B:
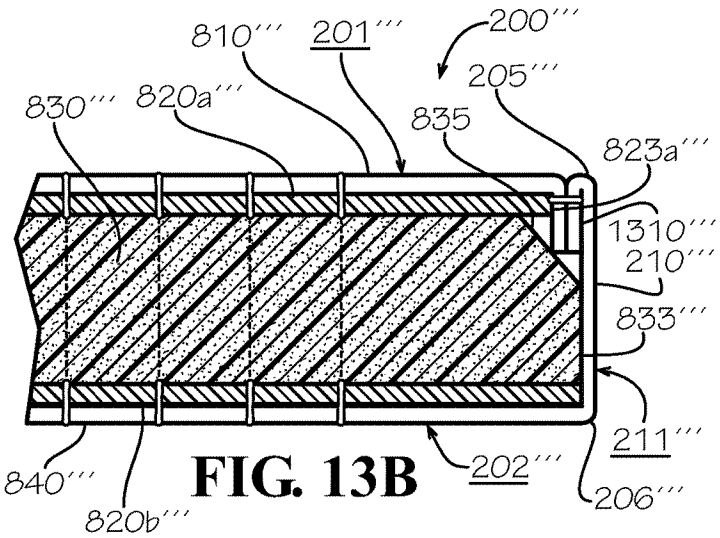
FIG. 13B is a detail sectional view of another embodiment of a brim of a hat taken from the view of detail 13 of FIG. 11.
Figure 13A:
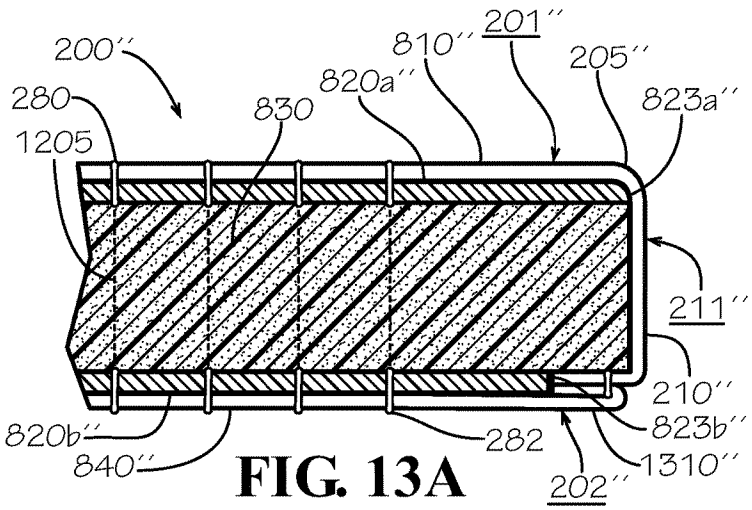
FIG. 13A is a detail sectional view of the brim of the hat of FIG. 1 taken from detail 13 of FIG. 11.

FIGS. 13A through 13D disclose various embodiments of the construction of a brim of a hat such as the brim 200 of the hat 100. FIG. 13A discloses a brim 200" including an upper cover 810" that wraps around or covers an outer edge 823*a*" of a surface insert 820*a*", the outer edge 823*a*" being rounded, and that also extends around and covers the core insert 830. In various embodiments, the rounding of the outer edge 823*a*" results in a more pronounced radius at an outer edge 205" of an upper surface 201" of the brim 200". FIG. 13A also discloses a lower cover 840" that wraps around or covers an outer edge 823*b*" of a surface insert 820*b*", the outer edge 823*b*" being sized to stop short of the face 210" in order to allow room for a joint 1310" to maintain a flat lower surface 202".

FIG. 13B discloses an upper cover 810'" that wraps around or covers an outer edge 823*a*'" of a surface insert 820*a*'". A core insert 830'" has been chamfered at the top of an outer edge 833". This chamfered edge 835 and an outer edge 823*a*'" that has been sized to stop short of the face 210'" both allow room for a joint 1310'" proximate the outer edge 205'" of the upper surface 201'" to maintain a flat upper surface 201'" and a flat face surface 211'". In various embodiments, an outer edge of a core insert 830'" will be offset from the face surface 211'" such that an open space is created between the core insert and the lower cover 840'" behind the face 210'".

Figure 13D:
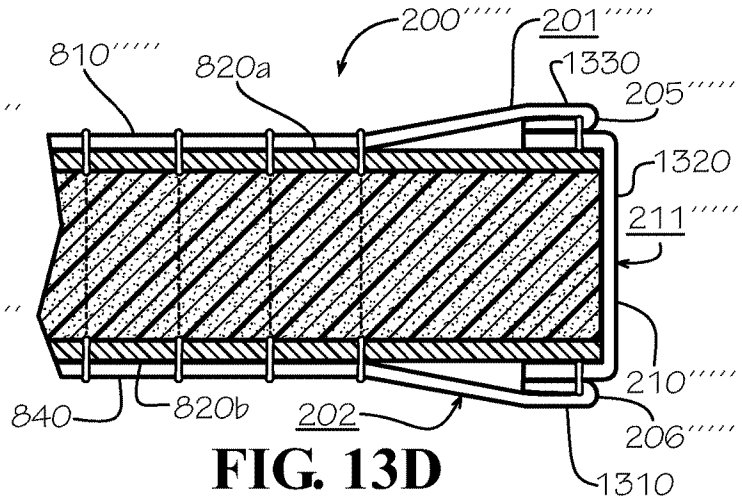
FIG. 13D is a detail sectional view of another embodiment of a brim of a hat taken from the view of detail 13 of FIG. 11.
Figure 13C:
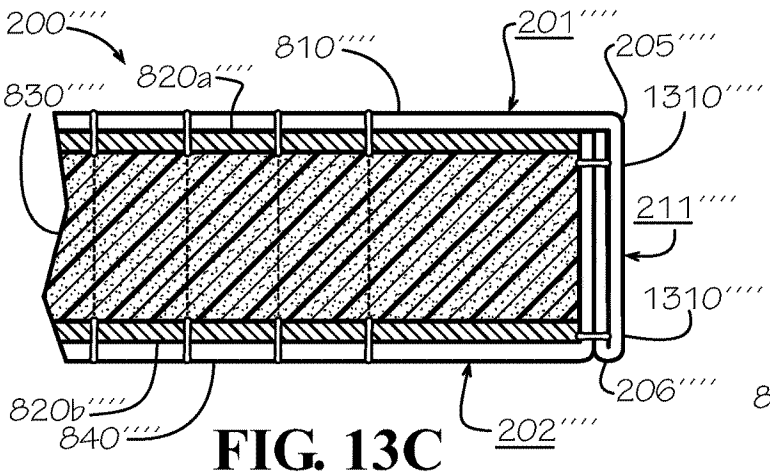
FIG. 13C is a detail sectional view of another embodiment of a brim of a hat taken from the view of detail 13 of FIG. 11.

FIG. 13C discloses an upper cover 810"" that wraps around or covers an outer edge 823*a*"" of a surface insert 820*a*"" and a lower cover 840"" that wraps around or covers an outer edge 823*b*"" of a surface insert 820*b*"". A joint 1310"" is sized and positioned respective to the surface inserts 820"" and a core insert 830"" to maintain a flat upper surface 201"", a flat lower surface 202"", and a flat face surface 211"".

FIG. 13D discloses an upper cover 810""" and a lower cover 840""" both joined to a face cover 1320 to form a face 210""" with a joint 1310 at the outer edge 206""" and a joint 1330 at the outer edge 205"""". The joint 1330 is positioned between the upper cover 810""" and the surface insert 820*a*. The joint 1310 is positioned between the lower cover 840 and the surface insert 820*b*. An upper cover and a lower cover and the associated structure of a brim such as the brim 200 could be constructed using any one of a number of different methods, including combinations of the details disclosed herein and even other methods that would be known by one of ordinary skill in the art of hat construction. In the various embodiments described herein, an upper cover such as the upper cover 810 and a lower cover such as the lower cover 840 are joined a joint such as the joint 1310 which in the current embodiment is a sewn joint. However, the disclosure of a sewn joint for the joint 1310 should not be considered limiting on the current disclosure as the joint 1310 may or may not require a sewn connection.

Figure 14:
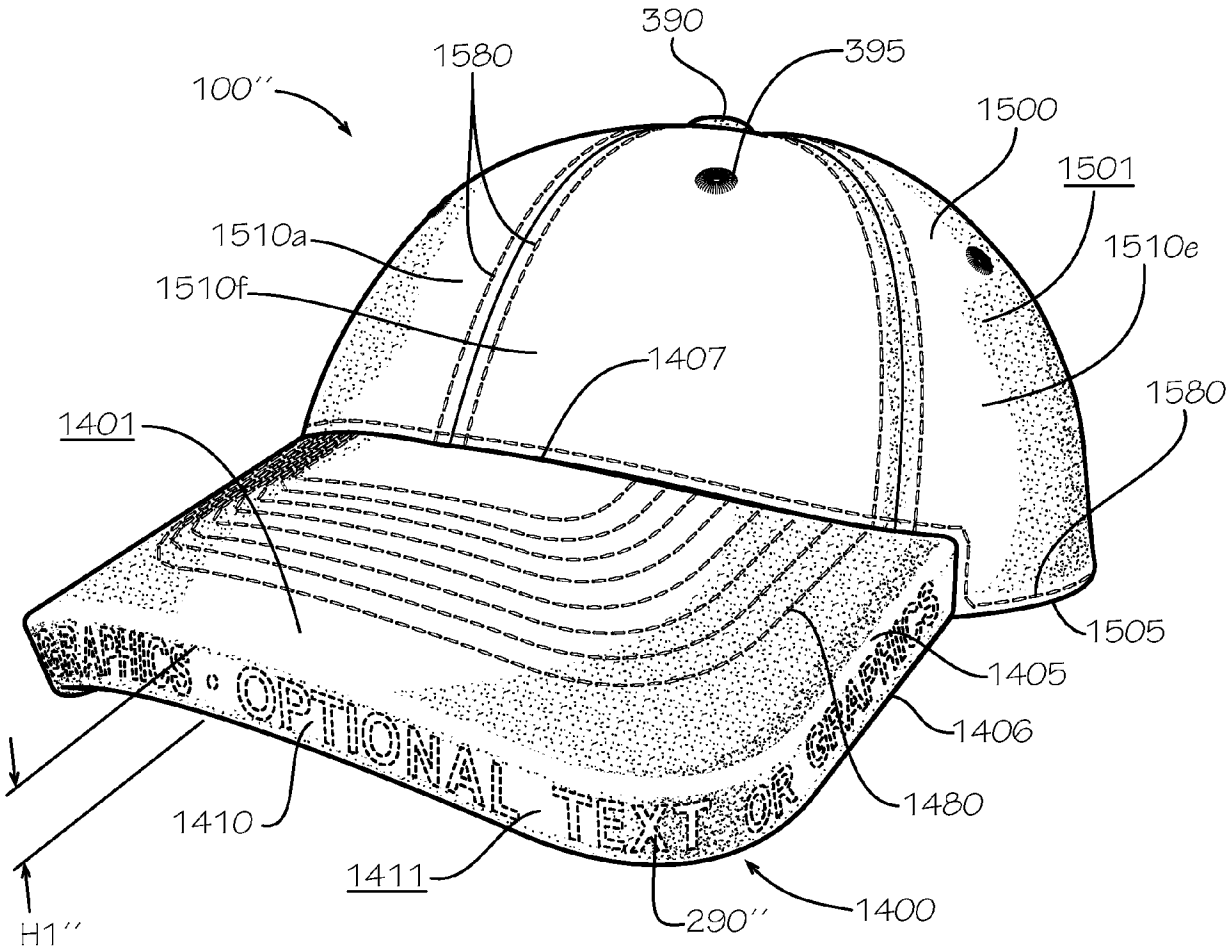
FIG. 14 is a perspective view of a hat with a curved brim in accordance with another embodiment of the current disclosure.

FIG. 14 discloses an embodiment of a hat 100" with a curved thick brim having a built-in radius of curvature. In various embodiments, the hat 100" includes a brim 1400 and a crown 1500. The brim 1400 defines an upper surface 1401, a lower surface 1402 (shown in FIG. 16), and a face 1410. The face 1410 defines a face surface 1411. In various embodiments, the face 1410 also defines face indicia 290". The face indicia 290' may be text as shown or may be any graphical display, with or without discernable text. The brim 1400 also defines a face height H1" between an outer edge 1405 of the upper surface 1401 and an outer edge 1406 of the lower surface 1402. In various embodiments, the brim 1400 defines a slight radius at the outer edge 1405 or the outer edge 1406 or in both locations. In various embodiments, the brim 1400 defines no discernable radius at the outer edge 1405 or at the outer edge 1406 or has a radius that is more pronounced than shown. In various embodiments, the brim 1400 includes stitching 1480, shown in the current embodiment in the upper surface 1401. In various embodiments, the lower surface 1402 includes stitching 1482 (shown in FIG. 16).

The crown 1500 of the hat 100" is formed from a plurality of panels 1510*a-f*, each of which may be uniquely shaped, sewn together with stitching 1580. The crown 1500 includes an outer surface 1501 and a lower edge 1505. The crown 1500 may also include one or more eyelets 395. In the current embodiment, one eyelet 395 is included in an upper portion of each panel 1510. In various embodiments, the crown 1500 includes a button 390.

Figure 15:
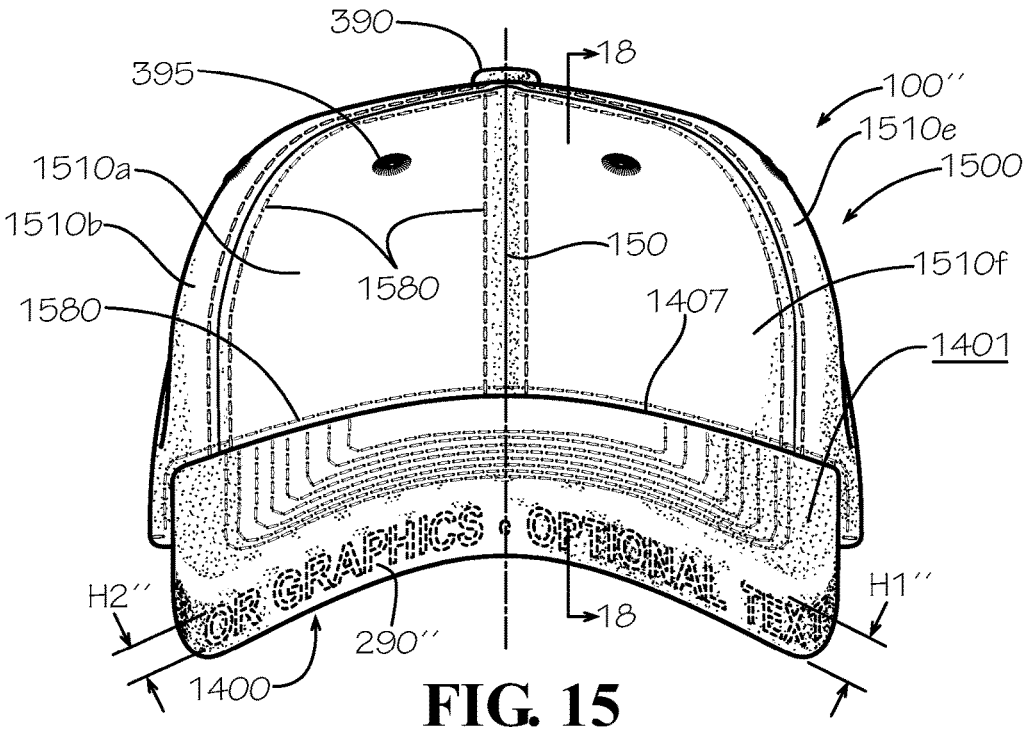
FIG. 15 is a front view of the hat of FIG. 14.

FIG. 15 discloses a front view of the hat 100". In various embodiments, the face indicia 290" have an indicia height H2" that is smaller than the face height H1'. In various embodiments, the indicia height H2" is constant. The disclosure of a constant indicia height H2" should not be considered limiting on the current disclosure, however, as some portions of the face indicia 290" may have a face height that is less than or greater than the indicia height H2".

Figure 16:
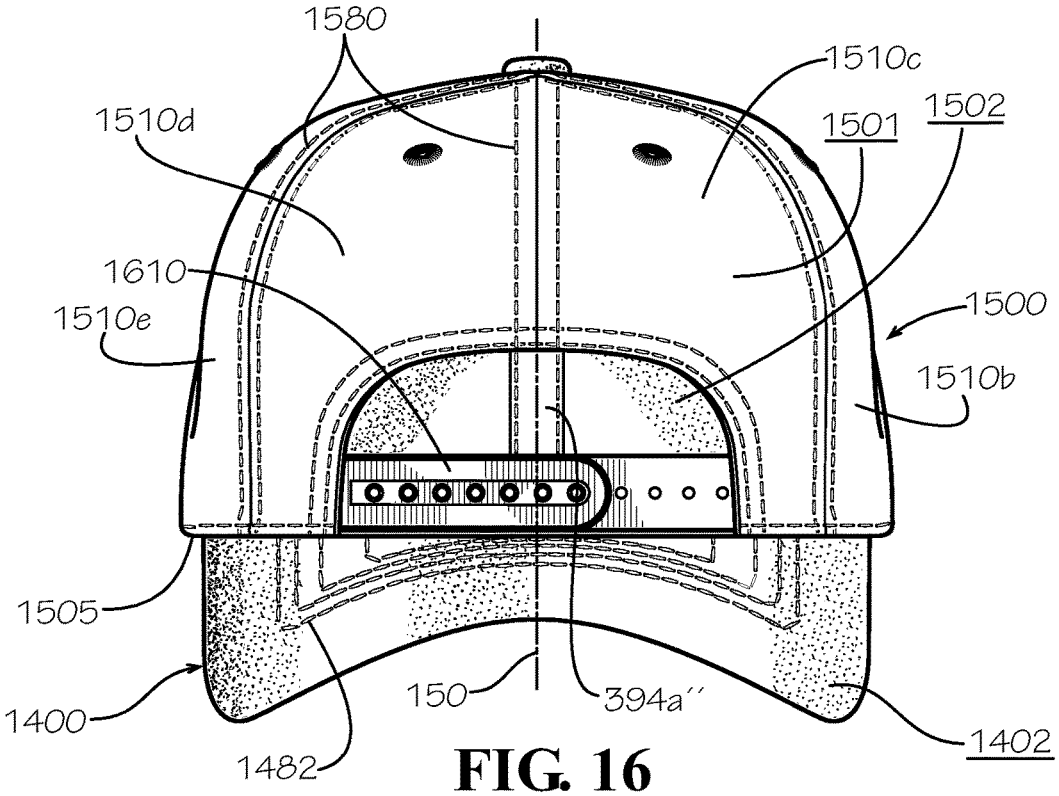
FIG. 16 is a rear view of the hat of FIG. 14.

FIG. 16 discloses a rear view of the hat 100. In various embodiments, the panels 1510*c* and 1510*d* of the crown 1500 form a rear portion of the crown 1500 that is at least partially open. For purposes of the current disclosure, for the rear portion of the crown 1500 to be "open" means that the rear portion of the crown 1500 defines one or more openings between the outer surface 1501 and the inner surface 1502 aside from the openings defined by eyelets 395. In various embodiments, the rear portion of the crown 1500 includes an adjustment device 1610 for adjusting the circumferential diameter of the hat as measured at the lower edge 1505 of the crown 1500.

Figure 17:
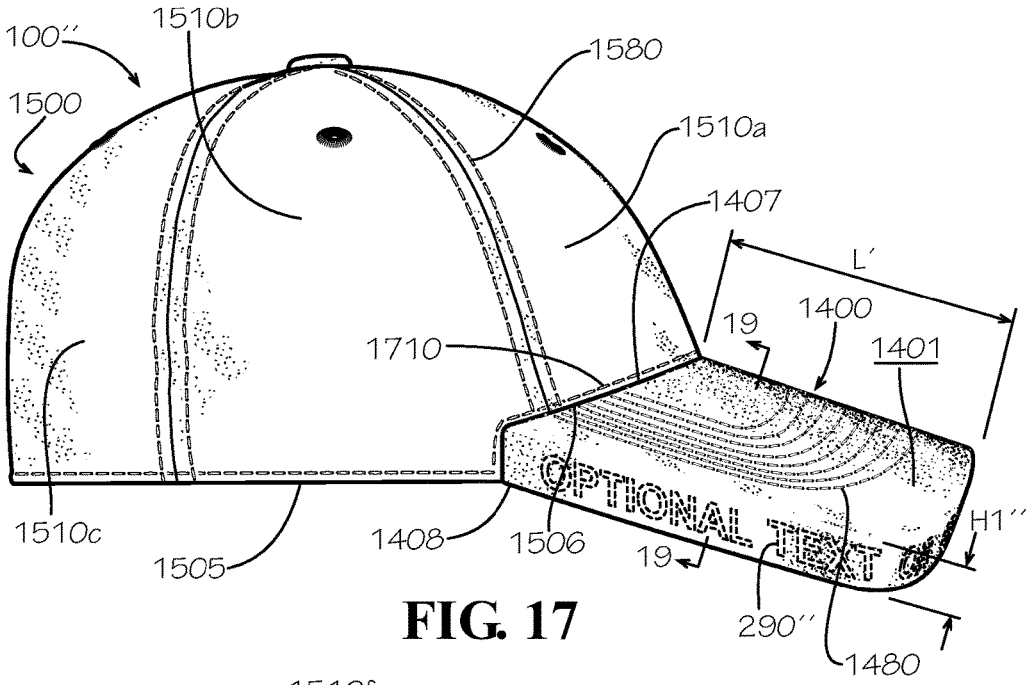
FIG. 17 is a side view of the hat of FIG. 14.

FIG. 17 discloses a side view of the hat 100". In various embodiments, the lower surface 1402—or a portion of the lower surface 1402 such as an inner edge 1408—of the brim 1400 is flush with the lower edge 1505 of the crown 1500. In such embodiments, the stitching 1580 that is offset from the lower edge 1505 of the crown 1500 and that extends around the bottom of the hat 100" or a front portion 1710 of the stitching 1580 that is offset from the brim 1400 follows or changes direction to match the profile of the brim 1400 where the brim 1400 is connected to the crown 1500. The brim 1400 extends a brim length L' from the inner edge 1407 of the upper surface 1401—or from a front edge 1506 of the crown 1500—along the plane of symmetry 150. In various embodiments, the brim length L' will equal between 27% and 30% of the overall length of the hat 100" measured along the same plane of symmetry 150, though other percentages may be present in various other embodiments and the disclosure of between 27% and 30% should not be considered limiting on the current disclosure.

Figure 18:
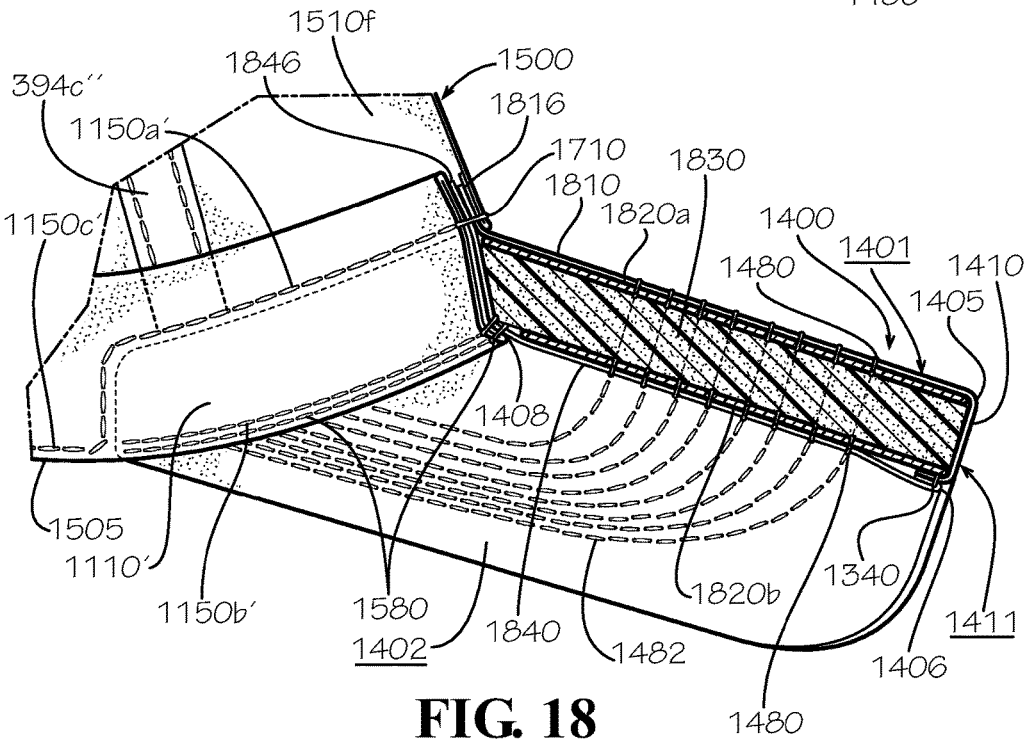
FIG. 18 is a sectional view of the hat of FIG. 14 taken along lines 18-18 of FIG. 15.

FIG. 18 discloses the internal structure of the hat 100" including the brim 1400 and the connection of the brim 1400 to the crown 1500 when the internal structure is viewed from the side. In various embodiments, the material forming an upper cover 1810 and the material forming a lower cover 1840 are sized to envelope or cover a core insert 1830 with surface inserts 1820*a,b* sandwiched in-between. In various embodiments, the material forming the upper cover 1810 and the material forming the lower cover 1840 are sized to also include connection flanges 1816,1846 on covers 1810, 1840, respectively, to which the crown 1500 and a sweatband 1110' are sewn along a stitching line 1150*a'* with stitching 1580. In various embodiments, stitching 1580 is also included to join the sweatband 1110' to the lower cover 1840 along a stitching line 1150*b'*. In various embodiments, stitching 1580 is included to join the sweatband 1110' and the lower edge 1505 of the crown 1500 along a stitching line 1150*c'*. In various embodiments, the result of this joining the sweatband 1110' to the lower edge 1505 of the crown 1500 will result in a hemmed or otherwise "clean" or smooth lower edge 1505. In various embodiment, one or more additional lines of stitching 1580 will join the sweatband 1100' to the lower cover 1840 or to other portions of the brim 1400 or crown 1500. In various embodiments, the upper cover 1810 and the lower cover 1840 are joined at the outer edge 1406 of the lower surface 1402 by a joint 1340 which in the current embodiment is a sewn joint. However, the disclosure of a sewn joint for the joint 1340 should not be considered limiting on the current disclosure as the joint 1340 may or may not require a sewn connection.

Figure 19:
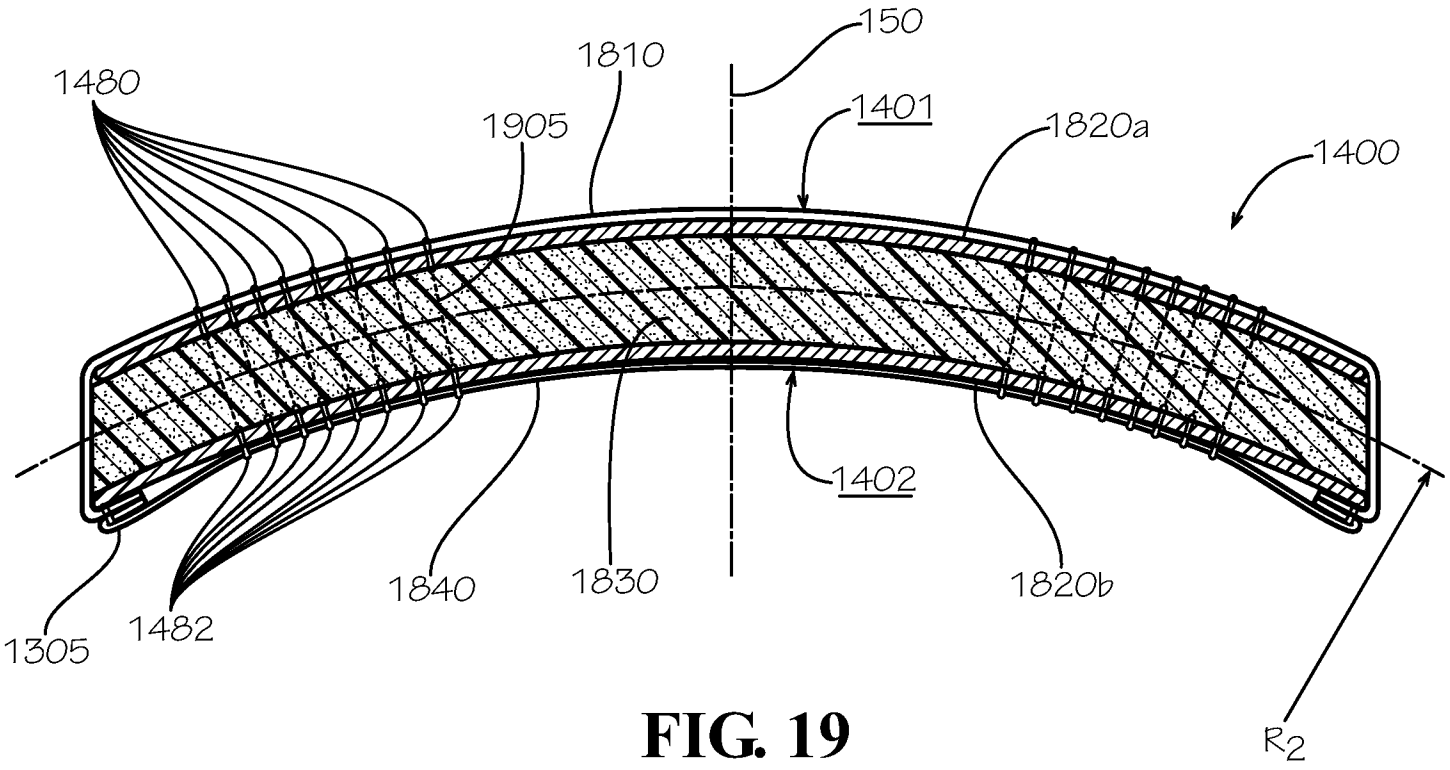
FIG. 19 is a sectional view of the hat of FIG. 14 taken along lines 19-19 of FIG. 17.

FIG. 19 discloses the internal structure of the brim 1400 of the hat 100" when the internal structure is viewed from the front. In various embodiments, the stitching 1480 in the upper surface 1401 will only connect the upper cover 1810 and the surface insert 1820*a*, and the stitching 1482 in the lower surface 1402 will only connect the lower cover 1840 and the surface insert 1820*b*, although the stitching may be aligned as shown by the dashed lines 1905 to make it appear that the stitching 1480 or stitching 1482 extends through the entire thickness of the brim 1400, which is equal to the face height H1" in various embodiments. As previously described, the structure of the hat 100" including the brim 1400 is symmetrical about a plane of symmetry 150 in various embodiments. If flexible materials are used for each component of the brim 1400 in various embodiments, the brim 200 may be allowed to flex so as to form a radius of curvature greater or less than the original radius of curvature R2 with which the hat is constructed. In various other embodiments where the brim 1400 more rigid materials in the brim 1400, the brim 1400 may be rigid such that it cannot flex or cannot permanently flex.

Figure 20:
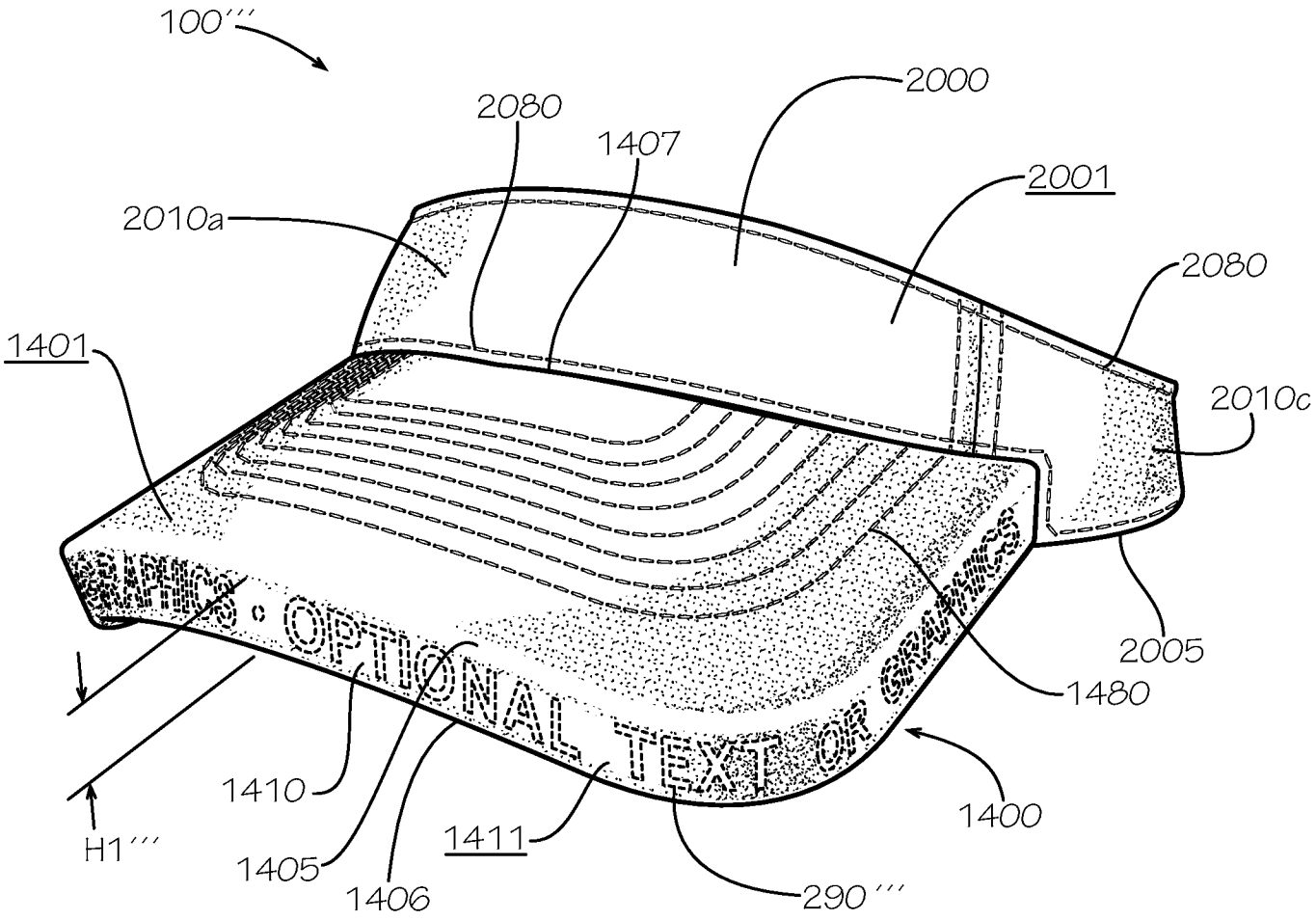
FIG. 20 is a perspective view of a hat with a curved brim and open crown in accordance with another embodiment of the current disclosure.

FIG. 20 discloses an embodiment of a hat 100''' with a curved thick brim and an open crown 2000. The hat 100''' can also be described as a visor. In various embodiments, the hat 100''' includes the brim 1400 and a crown 2000. The crown 2000 of the hat 100''' is formed from a plurality of panels 2010*a-c*, each of which may be uniquely shaped, sewn together with stitching 2080. The crown 2000 includes an outer surface 2001 and a lower edge 2005. The crown 2000 may also include one or more eyelets 395 although none are included in the current embodiment. In various embodiments, the brim 1400 is connected to the crown 2000 at an inner edge 1407 of the upper surface 1401 and at an inner edge 1408 of the lower surface 1402. In various embodiments not shown, a such as the brim 200 does not include a crown at all but is able to be secured or held to the head of a user by other structure such as a semi-rigid band similar in size to the sweatband 1100 and going partly around each side of the head or else a band going completely around the head.

Figure 22:
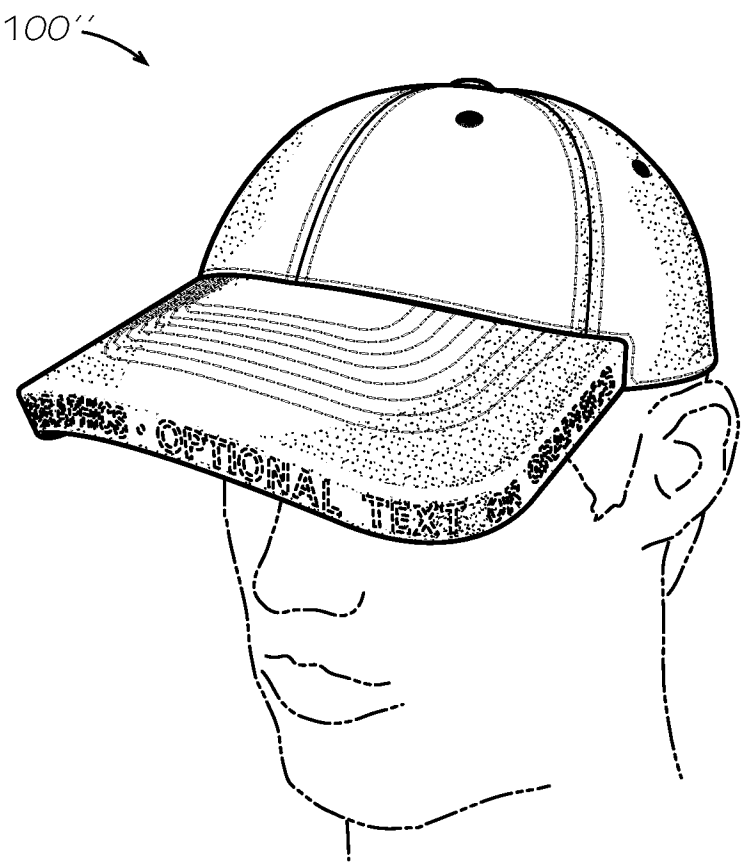
FIG. 22 is a perspective view of the hat of FIG. 14 as worn by a user in one embodiment.
Figure 21:
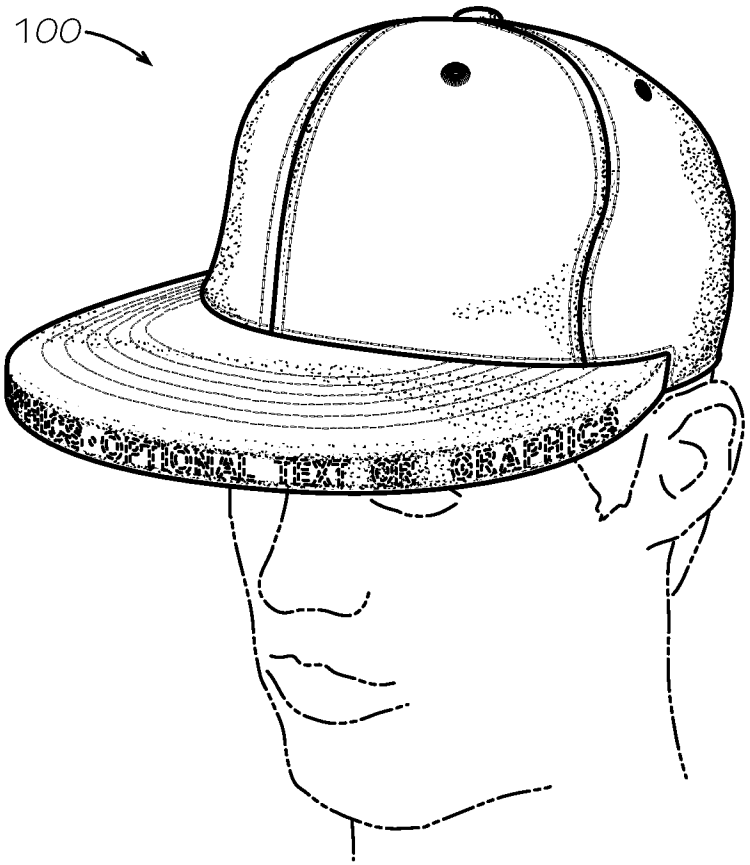
FIG. 21 is a perspective view of the hat of FIG. 1 as worn by a user in one embodiment.
Figure 23:
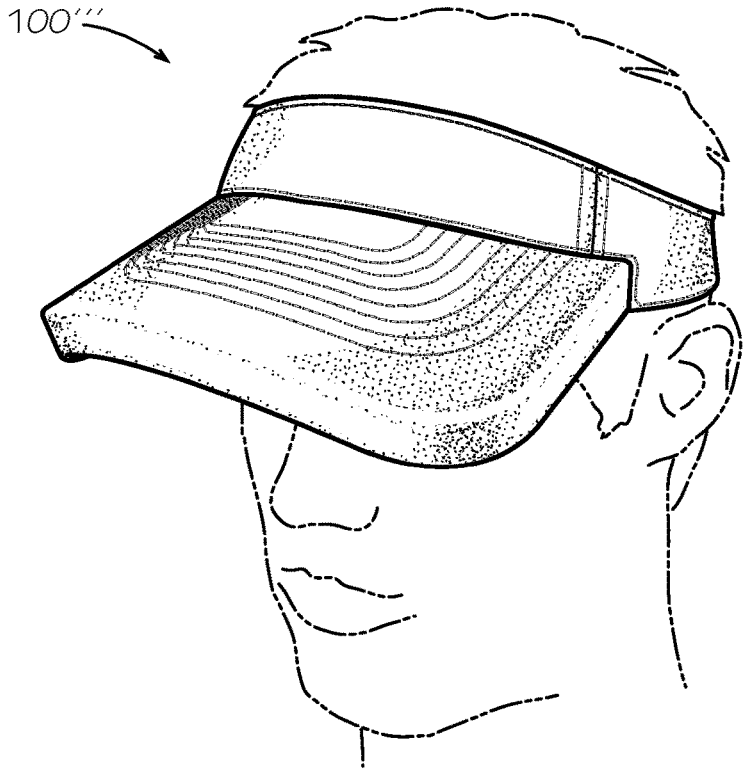
FIG. 23 is a perspective view of the hat of FIG. 20 as worn by a user in one embodiment.

FIGS. 21-23 disclose the hats 100, 100", and 100", respectively, as worn by a user in one embodiment of each. In various other embodiments, a user of each of the hats 100,100",100" wears each in a different orientation.

Figure 24:
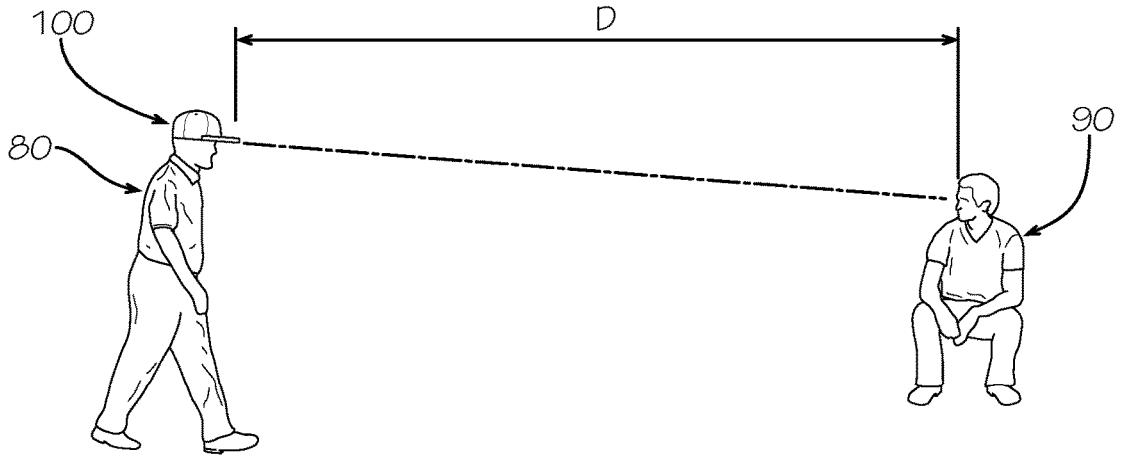
FIG. 24 is an elevation view showing a user wearing the hat of FIG. 1 with the hat positioned a distance from a viewer of the hat.

FIG. 24 discloses a user 80 of the hat 100 with the forward-most part of the hat 100 positioned a distance away from a viewer 90—a distance that is equal to an effective viewing distance D. For purposes of the current disclosure, an effective viewing distance D is the distance from which a portion of a hat such as the brim 200 of the hat 100 would be viewed directly by the naked eye with a person having 20/20 vision. In various embodiments and situations, a viewer may actually view a hat indirectly. In various embodiments, a viewer may view through the instrumentality of a television or computer screen—or any other device that projects, reflects, or transmits an image—a hat as worn by an athlete playing in a competition; the viewer may view a hat through a camera or video with a lens or lens system of variable magnification; or the viewer may view a hat indirectly by some other method of viewing that may alter visibility and make comparison of distances difficult apart from a method of equalizing those effects. In viewing scenarios where an image is viewed on an electronic or other device indirectly (as in scenarios other than that shown in FIG. 24), the effective viewing distance D may vary widely because of the variability in image size, image magnification, and image resolution. To illustrate the concept of the effective viewing distance D, the distance between a brim of a hat worn by a user of the hat displayed as an image on a computer screen and a viewer of the image on the computer screen will measure an effective viewing distance D of 20 feet if the user of the hat would create the same size image in the eye of the viewer when standing a physical distance of 20 feet away from the viewer as in FIG. 24.

On a hat crown that is large enough, information may be viewable or readable by another from a distance (beyond arm's length, for example). However, any graphics such as face indicia that might be possibly incorporated onto a typical hat brim, which measures less than 3/16" thick, are not easily visible when the hat is worn by a user. If a face height of such a typical brim is less than 3/16" high, and any face indicia added to a face of the brim were able to be made 1/8" tall to fit on the 3/16" high face, such face indicia would be readable from only less than about an arm's length distance. For purposes of the current disclosure, an arm's length distance is considered to be two and a half feet or 30" (762 mm). In many situations, however, it is desirable for a viewer to be able to read face indicia such as face indicia 290 from a distance of greater than arm's length.

In various embodiments, face indicia such as the face indicia 290 have an indicia height H2 of at least about 1/8" to 1" or more, including between 1/8" and 3/16", between 3/16" and 3/8", between 3/8" and 1/2", between 1/2" and 5/8" between 5/8" and 3/4", and between 3/4" and 1". In various embodiments, the face indicia 290 have an indicia height 290 of greater than 1". The disclosure of an indicia height H2 of at least about 1/8" to 1" or more, however, should not be considered limiting on the current disclosure. In various other embodiments, the indicia height will measure less than about 1/8".

In various embodiments, a relationship exists between the comfort of a hat such as the hat 100 and the thickness of a brim such as the brim 200, at least as far as comfort is perceived by a user. Reasons for not thickening the brim of a hat include the adverse effect that thickening the brim can have on the comfort of the hat. Structural or functional aspects of the design or use of a hat pertaining to comfort include, but are not limited to, the fit of the hat to the head of a user and the balance of the weight of the hat about the head of the user. Various embodiments of the current disclosure overcome the challenges of a thicker brim by incorporating into a hat such as the hat 100 not only a thicker brim such as the brim 200, the benefits of which are disclosed herein, but also by incorporating features such as those disclosed herein for making the hat 100 or specifically the brim 200 comfortable for a user to wear. These features includes, but are not limited to, the size and shape of a brim such as the brim 200, the density of the materials used to construct a brim such as the brim 200, the relative position of each of the components of a brim such as the brim 200 including in a hat such as the hat 100, and the location of stitching such as the stitching 380. By incorporating these and other features in various embodiments, the current disclosure maintains a balance between comfort and brim thickness or face height.

In various embodiments, the face height H1 of a face such as the face 210 of the brim 200 of the hat 100 will measure at least about 3/16" to 1" or more, including between 3/16" and 1/4", between 1/4" and 5/16", between 5/16" and 3/8", between 3/8" and 1/2", between 1/2" and 5/8", between 5/8" and 3/4", and between 3/4" and 1". In various embodiments, the face height H1 will be greater than 1".

A Snellen chart is a familiar chart still used by many optometrists to check an individual's visual acuity or eyesight. A LogMAR chart is a more recently developed tool for checking eyesight with some refinements over the Snellen chart. In various embodiments, the face indicia are readable by a person having 20/20 vision as determined by the Snellen chart (or LogMAR 0 vision) from an effective viewing distance of as much as 20 feet (approximately 6.1 meters) or more. In various embodiments, the face indicia are readable by a person having 20/20 vision as determined by a Snellen chart (or LogMAR 0 vision) from an effective viewing distance D of at least 15 feet (approximately 4.6 meters), from a distance D of at least 12 feet (approximately 3.6 meters), from a distance D of at least 9 feet (approximately 2.7 meters), from a distance D of at least 6 feet (approximately 1.8 meters), or from a distance D of at least 3 feet (approximately 0.9 meters). In various embodiments, the face indicia are readable by a person having 20/20 vision as determined by a Snellen chart (or LogMAR 0 vision) from an arm's length distance of 30" (762 mm) or from a double arm's length distance of 5 feet (approximately 1.5 mm).

Methods exist for evaluating the legibility of text from a distance that do not utilize the Snellen chart and LogMAR charts. One such method is the equation published by the United States Sign Council (USSC) in its publication titled "On-Premise Signs: Guideline Standards" (2003). As described in its publication, "[t]he USSC Standard Legibility Index is a numerical value representing the distance in feet for every inch of capital letter height at which a sign may be read. The table also reflects the 15 percent increase in letter height required when all upper case letters (all caps) are used instead of upper and lower case letters with initial caps, a difference in recognition distance documented in earlier studies by the researchers at the Pennsylvania Transportation Institute." The USSC publication explains that in order to "determine letter height for any given viewing distance, select the combination of illumination, letter style, letter color, and background color that most closely approximates those features on the sign being evaluated." The USSC publication then gives instructions to "divide the viewing distance (in feet) by the appropriate Legibility Index value. The result is the letter height in inches for the initial capital letter in upper and lower case configurations, or for every letter in an all caps configuration." According to the USSC publication, the Legibility Index value for externally lit black Helvetica type in all capital letters on a white background is 22. So based on the application of this formula to distances between 2.5 and 20 feet and assuming a Legibility Index value of 22, as-described Helvetica text having an indicia height of 0.114 inches (approximately 2.9 mm) is visible from a distance of 2.5 feet and as-described Helvetica text having an indicia height of 0.909 inches (approximately 23.1 mm) is visible from a distance of 20 feet. To the degree that differences exist between legibility of letters on a sign and legibility of letters on a hat and between the less understood USSC methods and the better understood Snellen and LogMAR charts, the use of the aforementioned USSC publication and the values calculated from the USSC method described herein, however, should not be considered limiting on the current disclosure.

Various methods may be employed to manufacture the hats 100,100",100". In various embodiments, the method includes forming a brim such as the brim 200 with a face height such as the face height H2 of the face 210 measuring at least 3/16" and incorporating face indicia such as face indicia 290 onto the face 210 of the brim 200.

In various embodiments, the method further includes adding stitching such as stitching 280 to at least a one of the upper surface 201 of the brim 200 and the lower surface 202 of the brim 200. In various embodiments, the method further includes assembling an outer insert such as a surface 820*a* to a one of the upper cover 810 and the lower cover 840 before assembling the upper cover 810 to the lower cover 840 or before assembling an inner insert such as a core insert 830 to the one of the upper cover 810 and the lower cover 840. In various embodiments, the method further includes incorporating face indicia 290 onto a cover of the brim 200, where the cover extends across the face 210, the upper surface 201, and the lower surface 202. In various embodiments, the method includes printing or embroidering the face indicia 290 onto the cover of the brim 200. In various embodiments, the method includes sewing the upper cover 810 to the lower cover 840 to form a brim casing. In various embodiments, the method includes adding adhesive across an upper surface and a lower surface of a core insert 830 or a surface insert 820*a,b*. In various embodiments, the method includes inserting an insert such as the core insert 830 into the brim casing. In various embodiments, the method includes attaching the brim 200 to the crown 300 and the sweatband 1100. In various embodiments, the attachment includes stitching such as the stitching 380. In various embodiments, the method includes sewing together a plurality of panels 310 to form a crown 300, sometimes referred to as a "beanie" in this incomplete state. In various embodiments, the method includes binding one or raw seams on an inside surface 302 of the crown 300 with a tape 394.

For purposes of the current disclosure, a dimension or distance measuring about X inches (or Y millimeters) measures within a range between X plus (or Y plus) an industry-standard upper tolerance for the specified measurement and X minus (or Y minus) an industry-standard lower tolerance for the specified measurement. Because tolerances can vary between different components and between different models of hats, the tolerance for a particular measurement of a particular component of a particular hat can fall within a range of tolerances. A typical tolerance for a dimension on a hat such as the face height H1 or the indicia height H2 of the hat 100 is plus 1/16" (or plus 1.6 millimeters) and minus 1/16" (or minus 1.6 millimeters).

In various embodiments, a thick brim such as the brim 200 will include a pocket accessory or a clip accessory.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A hat brim comprising:

an upper cover defining an upper surface;

a lower cover defining a lower surface offset from the upper surface, the upper surface and the lower surface together defining a tapered portion therebetween proximate to an inner edge of each of the upper surface and the lower surface, an angle in cross-section between the upper surface and a tapered surface of the tapered portion measuring less than 90 degrees and more than 0 degrees;

a surface insert positioned between the upper cover and the lower cover;

a core insert positioned between the surface insert and the lower cover and extending from an inner edge of the upper surface to an outer edge of the upper surface;

a face cover defining a face, the face extending from an outer edge of the upper surface to an outer edge of the lower surface, a face height of the face measuring at least ¼ inch;

an upper joint joining the upper cover to the face cover proximate to the outer edge of the upper surface, the upper joint comprising an outer edge of the upper cover and an upper edge of the face cover, both of the outer edge of the upper cover and the upper edge of the face cover hidden inside the finished upper joint, the upper surface of the upper cover facing a face surface of the face cover inside the upper joint, the upper joint positioned between the upper cover and the surface insert; and a lower joint joining the lower cover to the face cover proximate to the outer edge of the lower surface, the lower joint comprising an outer edge of the lower cover and a lower edge of the face cover, both of the outer edge of the lower cover and the lower edge of the face cover hidden inside the finished lower joint, the lower surface of the lower cover facing a face surface of the face cover inside the lower joint, the lower joint positioned between the lower cover and the core insert, each of the upper joint and the lower joint being a sewn joint.

2. The hat brim of claim 1, wherein the face defines face indicia formed from a printed or embroidered material, the face indicia having an indicia height of at least 3/16 inch but less than ⅜ inch.

3. The hat brim of claim 1, wherein the face defines face indicia formed from a printed or embroidered material, the face indicia having an indicia height of at least ⅜ inch but less than ½ inch.

4. The hat brim of claim 1, wherein the face defines face indicia formed from a printed or embroidered material, the face indicia having an indicia height of at least ½ inch.

5. The hat brim of claim 1, wherein the tapered surface of the tapered portion of the brim is substantially flat in cross section.

6. The hat brim of claim 1, wherein along a line extending through a centerline of the crown and through a centerline of the brim the core insert extends from the inner edge of the upper surface to the outer edge of the upper surface.

7. The hat brim of claim 6, wherein the core insert includes foam.

8. The hat brim of claim 6, wherein the core insert includes a material having a maximum density of one pound per cubic foot.

9. The hat brim of claim 1, wherein the thickness is substantially constant from an inner edge of the brim to an outer edge of the brim.

10. The hat brim of claim 1, wherein the hat brim is flat.

11. A hat comprising:

a crown defining a lower edge; and a brim, the brim including an upper cover defining an upper surface;

a lower cover defining a lower surface, at least a portion of the lower surface offset from a lower edge of the crown when viewed in cross-section from the side of the hat through a centerline of the hat when the lower surface is positioned parallel to the lower edge of the crown, the upper surface and the lower surface together defining a tapered portion therebetween proximate to an inner edge of each of the upper surface and the lower surface, an angle in cross-section between the upper surface and a tapered surface of the tapered portion measuring less than 90 degrees and more than 0 degrees;

a surface insert positioned between the upper cover and the lower cover, the surface insert comprising a plastic material;

a core insert positioned between the surface insert and the lower cover, the core insert comprising a foam material, the core insert extending from an inner edge of the brim to an outer edge of the brim;

a face cover defining a face, the face extending from an outer edge of the upper surface to an outer edge of the lower surface, a face height of the face measuring at least ¼ inch;

an upper joint joining the upper cover to the face cover proximate to the outer edge of the upper surface, the upper joint positioned between the upper cover and the surface insert; and a lower joint joining the lower cover to the face cover proximate to the lower edge of the lower surface, the lower joint positioned between the lower cover and the core insert, each of the upper joint and the lower joint being a sewn joint.

12. The hat brim of claim 1, wherein a thickness of the core insert is greater than a thickness of the surface insert.

13. The hat brim of claim 1, wherein along a line extending through a centerline of the crown and through a centerline of the brim the surface insert extends from an inner edge of the brim to an outer edge of the brim.

14. The hat brim of claim 1, wherein the core insert extends from an inner edge of the lower surface of the brim to an outer edge of the lower surface of the brim.

15. The hat of claim 11, wherein the tapered surface of the tapered portion of the brim is substantially flat in cross section.

16. The hat of claim 11, wherein along a line extending through a centerline of the crown and through a centerline of the brim both the surface insert and the core insert extend from the inner edge of the brim to the outer edge of the brim.

17. The hat of claim 1, wherein the brim further comprises a line of stitching.

18. The hat of claim 1, wherein the line of stitching extends through a thickness of the hat brim from the upper cover to the lower cover.

19. The hat of claim 11, wherein the brim further comprises a line of stitching.

20. The hat of claim 11, wherein the line of stitching extends through a thickness of the hat brim from the upper cover to the lower cover.

* * * * *